US011172308B2

(12) United States Patent
Graber

(10) Patent No.: US 11,172,308 B2
(45) Date of Patent: Nov. 9, 2021

(54) ELECTRIC MOTOR

(71) Applicant: Curtis E. Graber, Woodburn, IN (US)

(72) Inventor: Curtis E. Graber, Woodburn, IN (US)

( * ) Notice: Subject to any disclaimer, the term of this patent is extended or adjusted under 35 U.S.C. 154(b) by 87 days.

(21) Appl. No.: 16/273,769

(22) Filed: Feb. 12, 2019

(65) Prior Publication Data

US 2019/0182598 A1 Jun. 13, 2019

Related U.S. Application Data

(60) Continuation-in-part of application No. 15/797,404, filed on Oct. 30, 2017, now Pat. No. 10,375,479,
(Continued)

(51) Int. Cl.
*H04R 9/02* (2006.01)
*H04R 13/00* (2006.01)
(Continued)

(52) U.S. Cl.
CPC ..... *H04R 9/025* (2013.01); *H04R 13/00* (2013.01); *H04R 1/021* (2013.01); *H04R 9/04* (2013.01);
(Continued)

(58) Field of Classification Search
CPC .. H02K 1/12; H02K 1/18; H02K 1/20; H02K 1/22; H02K 1/28; H02K 1/30; H02K 5/20;
(Continued)

(56) References Cited

U.S. PATENT DOCUMENTS 3,877,314 A 4/1975 Bernin
4,339,874 A * 7/1982 Mc'Carty ..... H02K 1/278 29/598
(Continued)

FOREIGN PATENT DOCUMENTS

DE 197 25 373 A1 12/1998
WO 2014137009 A1 9/2014

OTHER PUBLICATIONS

Notification of Transmittal of the International Search Report and the Written Opinion of the International Searching Authority, or the Declaration dated Oct. 20, 2016 for International Application No. PCT/US2016/041319 (11 pages).

*Primary Examiner* — Tran N Nguyen
(74) *Attorney, Agent, or Firm* — Taylor IP, P.C.

(57) ABSTRACT

An electric motor including two magnetic assemblies each having an even number of magnets in a circular arrangement, the magnets arranged in a bucking configuration with like poles directed at each other. There are a plurality of ferrous members for each of the magnetic assemblies arranged between each of the magnets. The ferrous members having a face that is directed radially toward a face of another ferrous member of the corresponding magnetic assembly. An electromagnetic assembly has a plurality of electromagnetic members arranged in a generally circular arrangement and is located radially between the two magnetic assemblies. Each electromagnetic member has a ferrous element with an electrical conductor wound around the ferrous element, each ferrous element having an inward and outward face respectively being directed to the ferrous members of the two magnetic assemblies as they pass each other as the magnet assemblies rotate relative to the electromagnetic assembly.

19 Claims, 35 Drawing Sheets

Related U.S. Application Data which is a continuation-in-part of application No. 15/151,908, filed on May 11, 2016, now Pat. No. 9,807,510, which is a division of application No. 14/817,513, filed on Aug. 4, 2015, now Pat. No. 9,668,060, and application No. 16/273,769, Feb. 12, 2019.

(60) Provisional application No. 62/629,783, filed on Feb. 13, 2018.

(51) Int. Cl.
*H04R 9/04* (2006.01)
*H04R 1/02* (2006.01)

(52) U.S. Cl.
CPC .. *H04R 2209/021* (2013.01); *H04R 2209/022* (2013.01)

(58) Field of Classification Search
CPC ..... H02K 9/19; H02K 9/197; H02K 15/00; H02K 15/03; H02K 16/00; H02K 16/02; H02K 21/14; H02K 21/22; H02K 21/222; H02K 23/00; H02K 23/04; H02K 23/40; H02K 25/00; H02K 26/00; H02K 29/00; H02K 29/08; H02K 47/00; H02K 47/04; H02K 99/00; F02N 11/00; F02N 11/04
See application file for complete search history.

(56) References Cited

U.S. PATENT DOCUMENTS 4,700,097 A * 10/1987 Kawada ..... H02K 21/14 310/156.45
5,142,260 A 8/1992 House
5,446,797 A 8/1995 Paddock
5,898,544 A 4/1999 Krinke et al.
6,542,617 B1 4/2003 Fujihira et al.
6,563,932 B2 5/2003 Cork
6,590,312 B1 * 7/2003 Seguchi ..... B60L 15/2009 310/266
6,879,075 B2 * 4/2005 Calfo ..... H02K 1/2766 310/156.01
6,940,992 B2 9/2005 Stiles
7,006,654 B2 2/2006 Stiles et al.
8,861,776 B2 10/2014 Lastrucci
8,891,809 B2 11/2014 Danovi
9,161,141 B2 10/2015 Martius et al.
9,312,924 B2 4/2016 Ozaki et al.
10,375,479 B2 * 8/2019 Graber ..... H04R 9/025
2001/0031060 A1 10/2001 Carver
2002/0131612 A1 9/2002 Son
2004/0086150 A1 5/2004 Stiles
2004/0156527 A1 8/2004 Stiles et al.
2005/0031154 A1 2/2005 Stiles
2005/0175213 A1 8/2005 Stiles
2005/0190945 A1 9/2005 Calderwood et al.
2006/0182303 A1 8/2006 Trandafir
2006/0204028 A1 9/2006 Lim
2007/0075906 A1 4/2007 Forster et al.
2010/0050702 A1 * 3/2010 Kim ..... D06F 37/40 68/23 R
2011/0062916 A1 3/2011 Farahani
2011/0285238 A1 * 11/2011 Kusase ..... H02K 16/04 310/156.48
2012/0051188 A1 3/2012 Graber
2012/0257646 A1 10/2012 Yee
2013/0142364 A1 6/2013 Heed

* cited by examiner

ELECTRIC MOTOR

CROSS REFERENCE TO RELATED APPLICATIONS

This is a continuation-in-part application based upon U.S. non-provisional patent application Ser. No. 15/797,404, entitled "ELECTRIC MOTOR", filed Oct. 30, 2017, which is incorporated herein by reference. Patent application Ser. No. 15/797,404 is a continuation-in-part application based upon U.S. non-provisional patent application Ser. No. 15/151,908, entitled "TRANSDUCER", filed May 11, 2016, which has issued as U.S. Pat. No. 9,807,510. Application Ser. No. 15/151,908 was a divisional application based upon U.S. non-provisional patent application Ser. No. 14/817,513, entitled "TRANSDUCER", filed Aug. 4, 2015, which has issued as U.S. Pat. No. 9,668,060. This application also claims priority to U.S. provisional application No. 62/629,783, entitled "ELECTRIC MOTOR", filed Feb. 13, 2018, which is incorporated herein by reference.

BACKGROUND OF THE INVENTION

1. Field of the Invention

The present invention relates to electric motors and more specifically to rotary electric motors for the driving of a rotating load.

2. Description of the Related Art

A speaker is a type of electro-acoustic transducer or linear motor, which is a device that converts an electrical signal into mechanical movement that produces sound corresponding to the signal.

Linear motors are an electric motor that produces a linear force along a length of the motor. The most common version has magnets of alternating polarities aligned along a plane with electrical coils changing polarity proximate to the magnets.

Rotary motors are an electric motor that produces a rotating motion and force on a shaft of the motor. The most common version has magnets of alternating polarities aligned about a circumference with electrical coils changing polarity proximate to the magnets.

Electric motors often include a rotor, a stator, bearings, an air gap and windings with some motors including permanent magnets. The stator is the stationary part of the motor's electromagnetic circuit and usually consists of either windings or permanent magnets. A typical stator core is made up of many thin metal sheets, in the form of laminations. The use of laminations are preferred in order to reduce energy losses that would result if a solid core were used. The rotating part of the motor is referred to as the rotor, which turns the shaft to deliver mechanical power to a load. The rotor can have conductors that carry electrical currents to create the magnetic fields, which interact with the magnetic fields of the stator to generate the forces that result in the turning of the shaft. Alternatively, some rotors carry permanent magnets, and the stator has the electrical conductors.

A permanent-magnet motor uses permanent magnets embedded in the steel rotor to create a constant magnetic field. The stator uses windings connected to an AC supply to produce a rotating magnetic field that drives the rotor. At synchronous speed the rotor poles lock to the rotating magnetic field, thus synchronizing the speed of rotation with the AC frequency.

What is needed in the art is an electric rotary motor which has increased effectiveness that will allow more compact designs and will result in more efficient production of movement.

SUMMARY OF THE INVENTION

The present invention provides an electric motor that uses magnetic constructs that have an intense magnetic field over a portion of a cycle.

The present invention in one form is an electric motor including two magnetic assemblies each having an even number of magnets in a circular arrangement, the magnets arranged in a bucking configuration with like poles directed at each other. There are a plurality of ferrous members for each of the magnetic assemblies arranged between each of the magnets. The ferrous members having a face that is directed radially toward a face of another ferrous member of the corresponding magnetic assembly. Additionally an electromagnetic assembly has a plurality of electromagnetic members arranged in a generally circular arrangement and is located radially between the two magnetic assemblies. Each electromagnetic member has a ferrous element with an electrical conductor wound around the ferrous element, each ferrous element having an inward and outward face respectively being directed to the ferrous members of the two magnetic assemblies as they pass each other as the magnet assemblies rotate relative to the electromagnetic assembly.

The present invention in another form is directed to a load driving machine with a load coupled to an electric motor including two magnetic assemblies each having an even number of magnets in a circular arrangement, the magnets arranged in a bucking configuration with like poles directed at each other. There are a plurality of ferrous members for each of the magnetic assemblies arranged between each of the magnets. The ferrous members having a face that is directed radially toward a face of another ferrous member of the corresponding magnetic assembly. Additionally an electromagnetic assembly has a plurality of electromagnetic members arranged in a generally circular arrangement and is located radially between the two magnetic assemblies. Each electromagnetic member has a ferrous element with an electrical conductor wound around the ferrous element, each ferrous element having an inward and outward face respectively being directed to the ferrous members of the two magnetic assemblies as they pass each other as the magnet assemblies rotate relative to the electromagnetic assembly.

The present invention advantageously produces an intense magnetic field.

Another advantage of the present invention is that it allows the electric motor to efficiently utilize the electrical power provided thereto.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
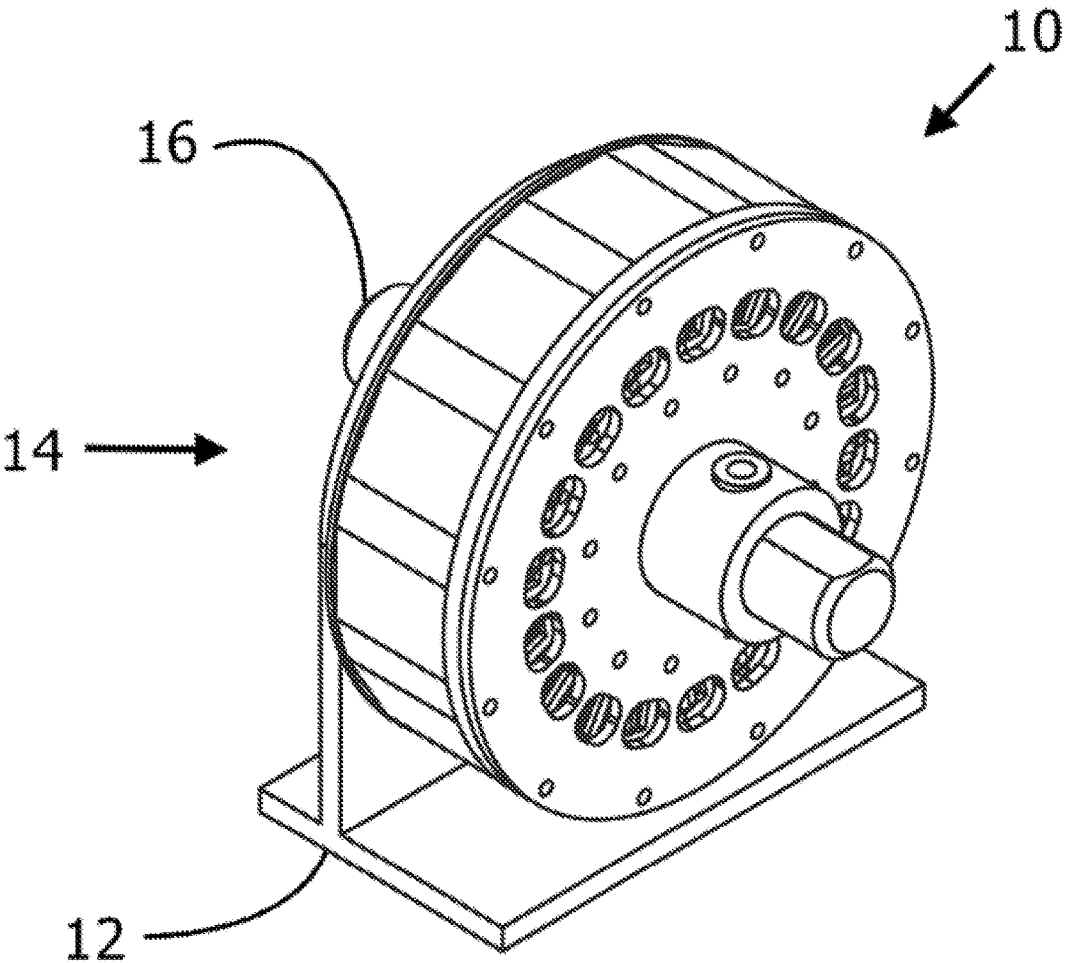
FIG. 1 is a perspective view of an embodiment of an electric motor of the present invention.
Figure 2:
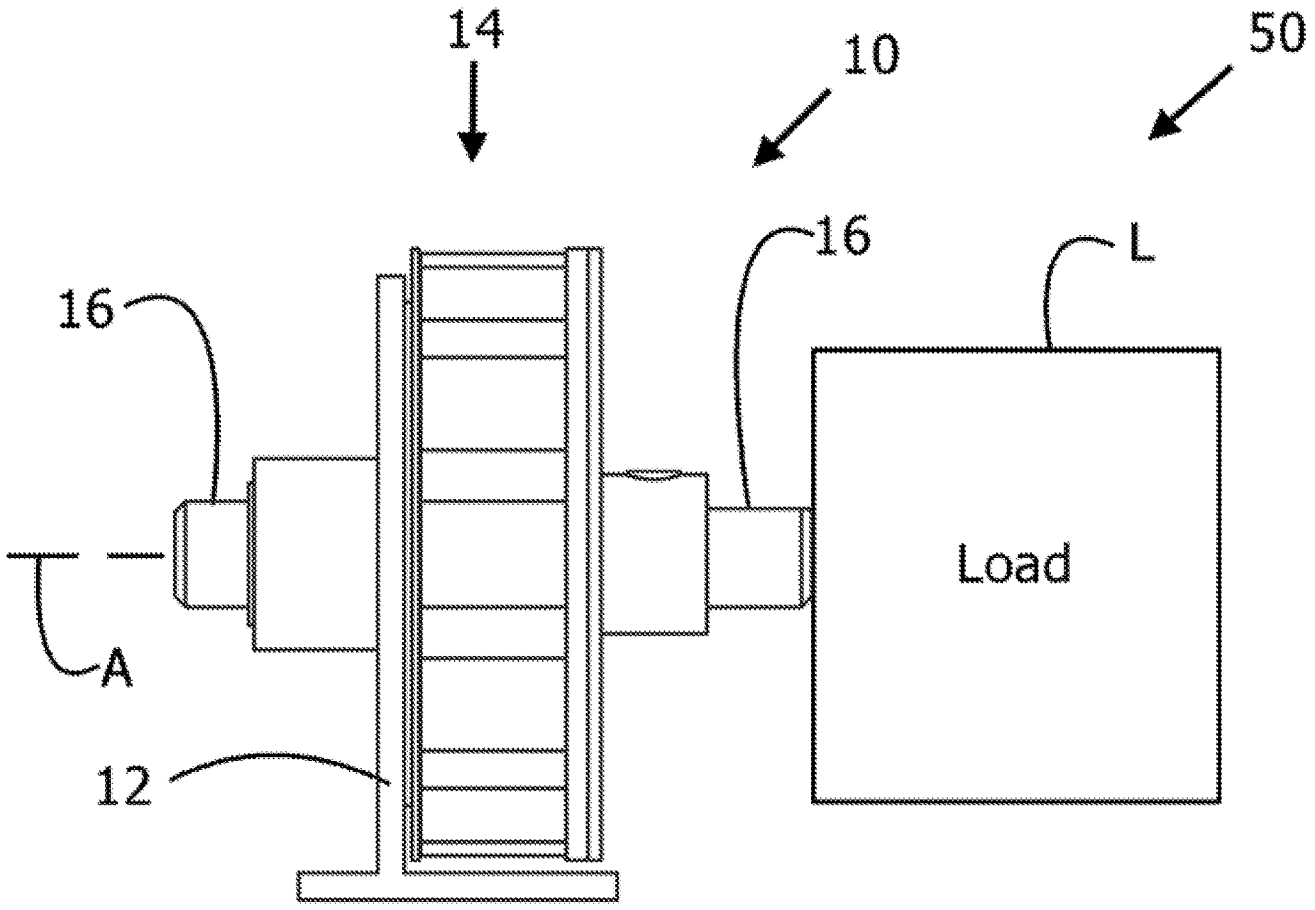
FIG. 2 is a side view of a load driving machine using the electric motor of FIG. 1.

Referring now to the drawings, and more particularly to FIG. 1, there is shown an electric motor 10 including a mounting system 12, a rotor assembly 14, and a shaft 16 coupled to the rotor assembly 14. In FIG. 2 there is illustrated a load driving machine 50 in the form of electric motor 10 being coupled to a load L by way of shaft 16. Load L is schematically shown and can represent a drive train in a vehicle or other load that will be rotationally moved by power being transferred thereto from shaft 16.

Figure 3:
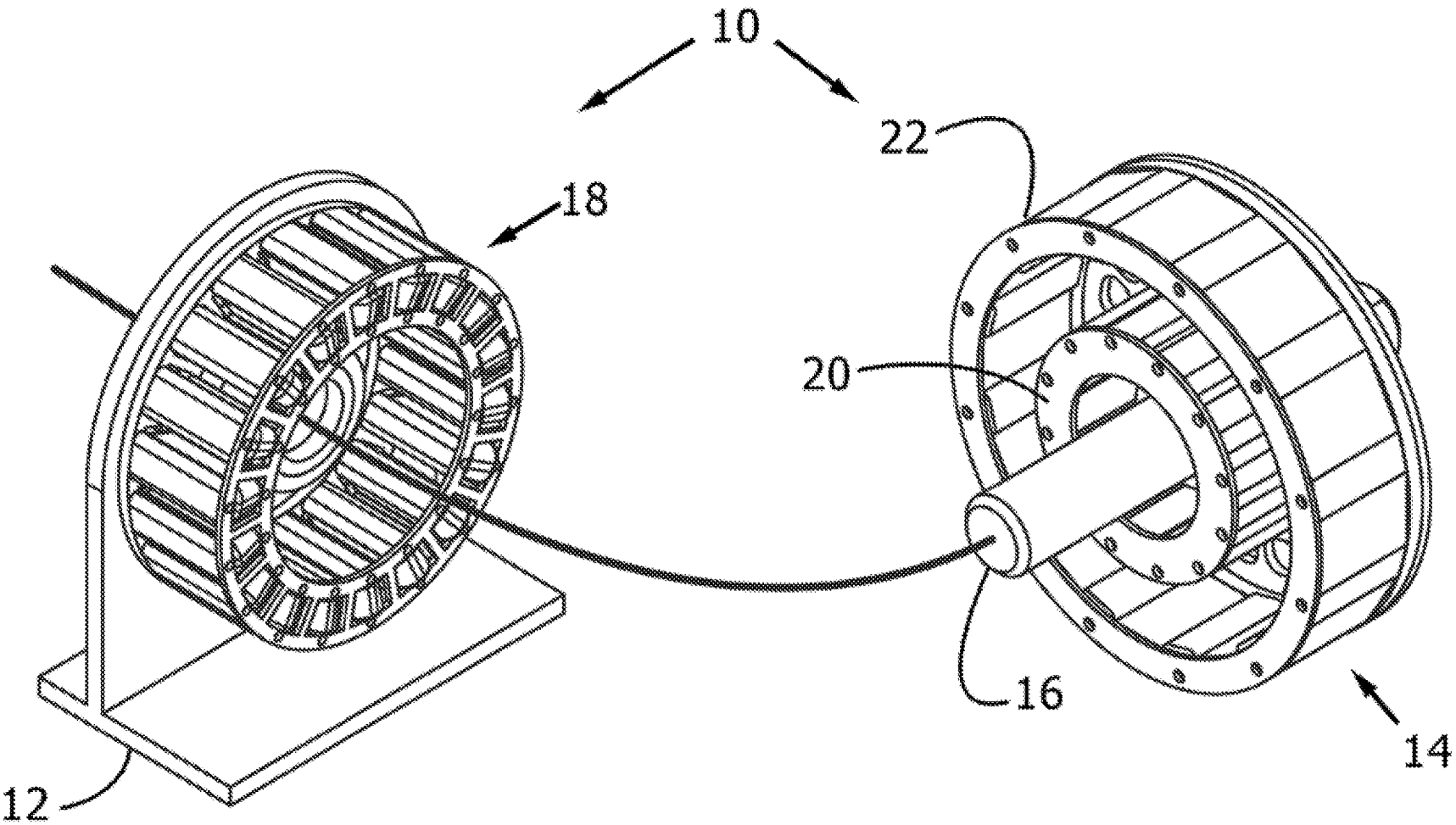
FIG. 3 is a perspective exploded view of the electric motor of FIGS. 1 and 2 illustrating a stator and a rotor.

Now, additionally referring to FIG. 3 there is shown an exploded view of motor 10 with stator 18 shown coupled to mounting system 12. Rotor 14 has an inner portion 20 and an outer portion 22, which are both magnetic assemblies 20 and 22, the configuration of which are more fully illustrated in the subsequent figures.

Figure 4:
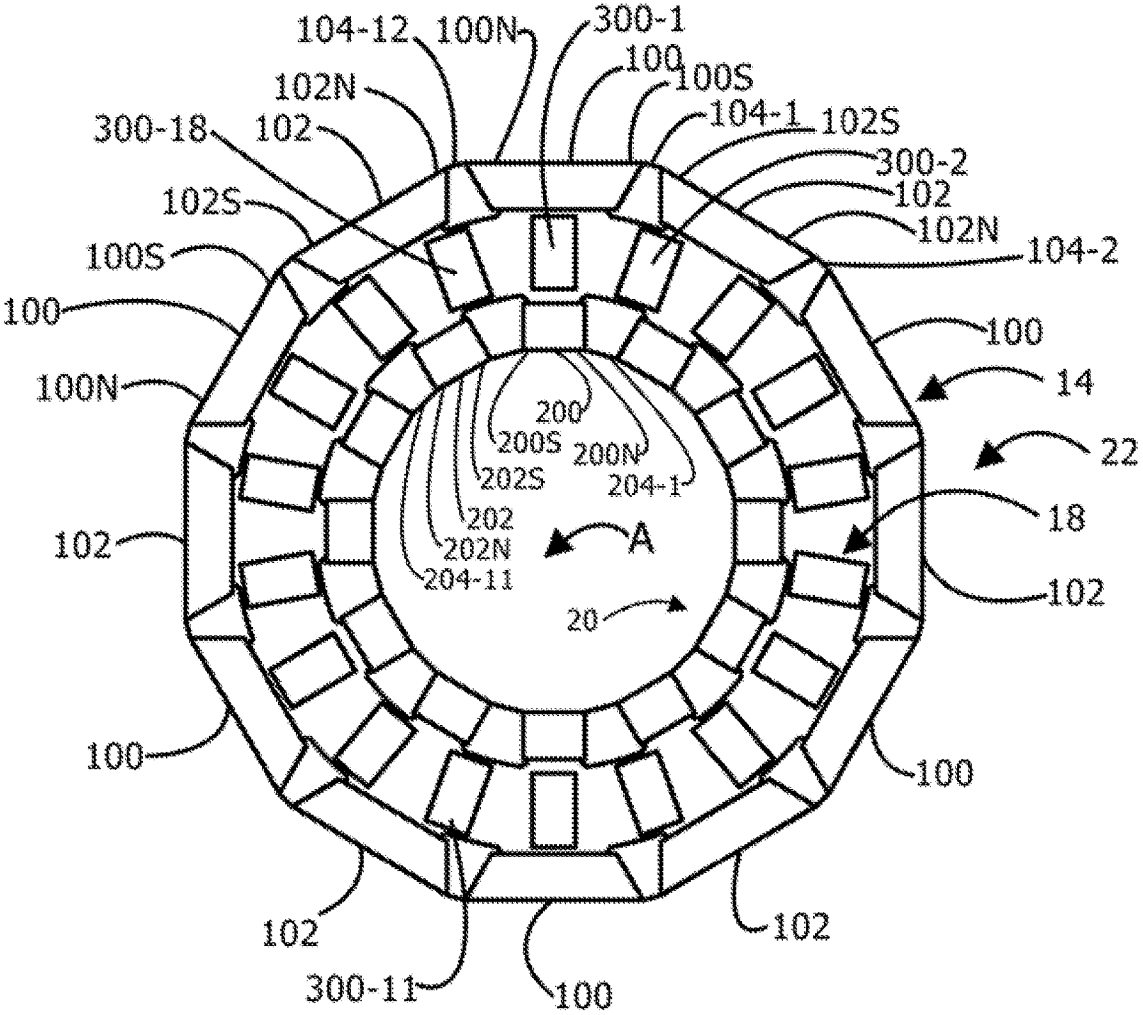
FIG. 4 is a schematizied view of interior components of the electric motor of FIGS. 1-3.

Now, additionally referring to FIG. 4, there is illustrated, in a schematic form, the relative positions of magnetic assemblies 20 and 22 as well as components of stator 18. Here outer magnetic assembly 22 is made up of magnets 100 and 102 along with ferrous members 104 positioned between adjacent magnets. Magnets 100 and 102 are positioned with the same polarities directed toward each other with ferrous member 104 therebetween. Each magnet 100 and 102 have corresponding pole ends 100S, 100N and 102N, 102S, with the N and S suffixes denoted the North and South poles of magnets 100 and 102. Magnets 100 and 102 may be identical, with their poles being aligned in opposite directions along an arc with a radius from axis A that makes a complete circle in what can be described as a generally circular arrangement. As a result of the end-to-end placement of magnets 100 and 102, the total number of magnets is an even number, as in this example there are a total of twelve magnets in magnetic assembly 22. Ferrous members 104 are here indicated as 104-1 through 104-12, where shown, so that they can be addressed as needed in a discussion that follows.

Note, ferrous members 104 are generally symmetrically trapezoidal in shape with a portion that extends inwardly that also extends along a portion of the sides of the adjacent magnets. There are a similar number of ferrous members 104 as there are the total number of magnets 100 and 102. The shape of ferrous members 104 accommodate the beveled pole ends 100N, 100S, 102N, 102S to accommodate magnetic coupling thereto.

Magnetic assembly 20 is similar to magnetic assembly 22, but in a more compact arrangement. Inner magnetic assembly 20 is made up of magnets 200 and 202 along with ferrous members 204 positioned between adjacent magnets. Magnets 200 and 202 are positioned with the same polarities directed toward each other with ferrous member 204 therebetween. Each magnet 200 and 202 have corresponding pole ends 200S, 200N and 202N, 202S, with the N and S suffixes denoted the North and South poles of magnets 200 and 202. Magnets 200 and 202 may be identical, with their poles being aligned in opposite directions along an arc with a radius from axis A that makes a complete circle in what can be described as a generally circular arrangement. The radius of magnetic assembly 20 is smaller than the radius of magnetic assembly 22. As a result of the end-to-end placement of magnets 200 and 202, the total number of magnets is an even number, as in this example there are a total of twelve magnets in magnetic assembly 20. Ferrous members 204 are here indicated as 204-1 through 204-12, where shown, so that they can be addressed as needed in a discussion that follows.

Note, ferrous members 204 are generally symmetrically trapezoidal in shape with a portion that extends radially outwardly that also extends along a portion of the sides of the adjacent magnets. There are a similar number of ferrous members 204 as there are the total number of magnets 200 and 202. The shape of ferrous members 204 accommodate the beveled pole ends 200N, 200S, 202N, 202S to accommodate magnetic coupling thereto.

The magnetic strength of magnets 100, 102, 200, and 202 are generally the same, and may be substantially similar in strength. Note, the magnetic polarity of ferrous member 104-1 is opposite of that of ferrous member 204-1, and this arrangement exists throughout rotor 14.

Stator 18 incudes electromagnetic members 300-1 through 300-18, where numbered for purposes of discussion. For the sake of clarity several of members 300 are not separately identified. Electromagnetic members 300 do not have windings shown, but it should be understood that such is included in the description, with members 300 optionally having a ferrous core and the windings of electrical conductors may be wound around the internal ferrous core, if there is such a core present. It should also be noted that magnets and electromagnets may be used interchangeably as is desired in the construct of the present invention. Here electromagnetic members 300 can also be described as magnetic driving elements 300, with the polarity and magnetic strength being established by a control mechanism that switches polarity of the magnetic field at desired positions of rotor 14 relative to stator 18 (and with timing offsets that may correspond to the speed of rotor 14 and the load placed on shaft 16).

Figure 5:
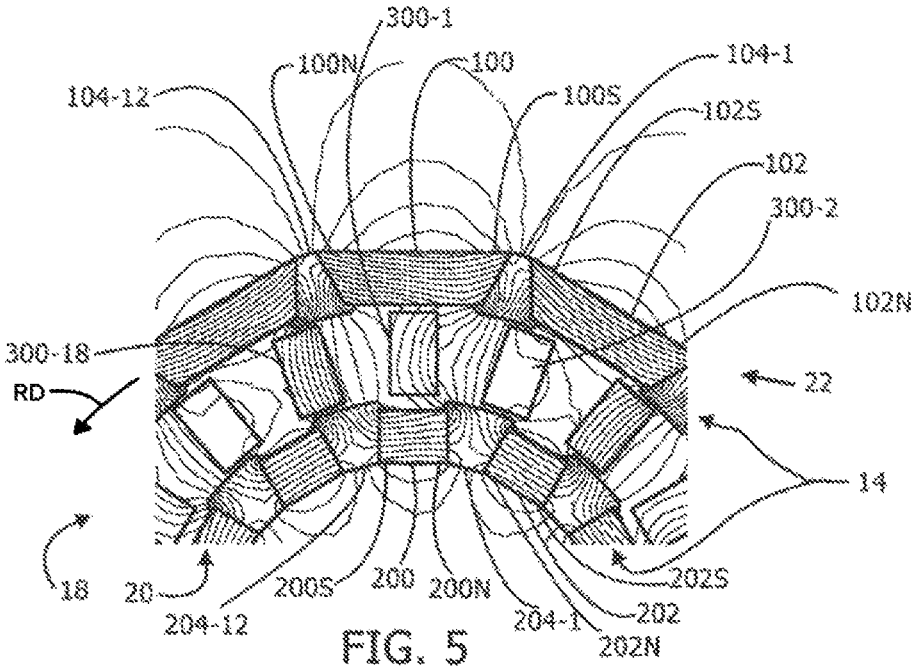
FIG. 5 is a closer schematizied view of the electric motor of FIGS. 1-4 showing magnetic field lines of a portion of components at a starting point of similar figures that follow.
Figure 6:
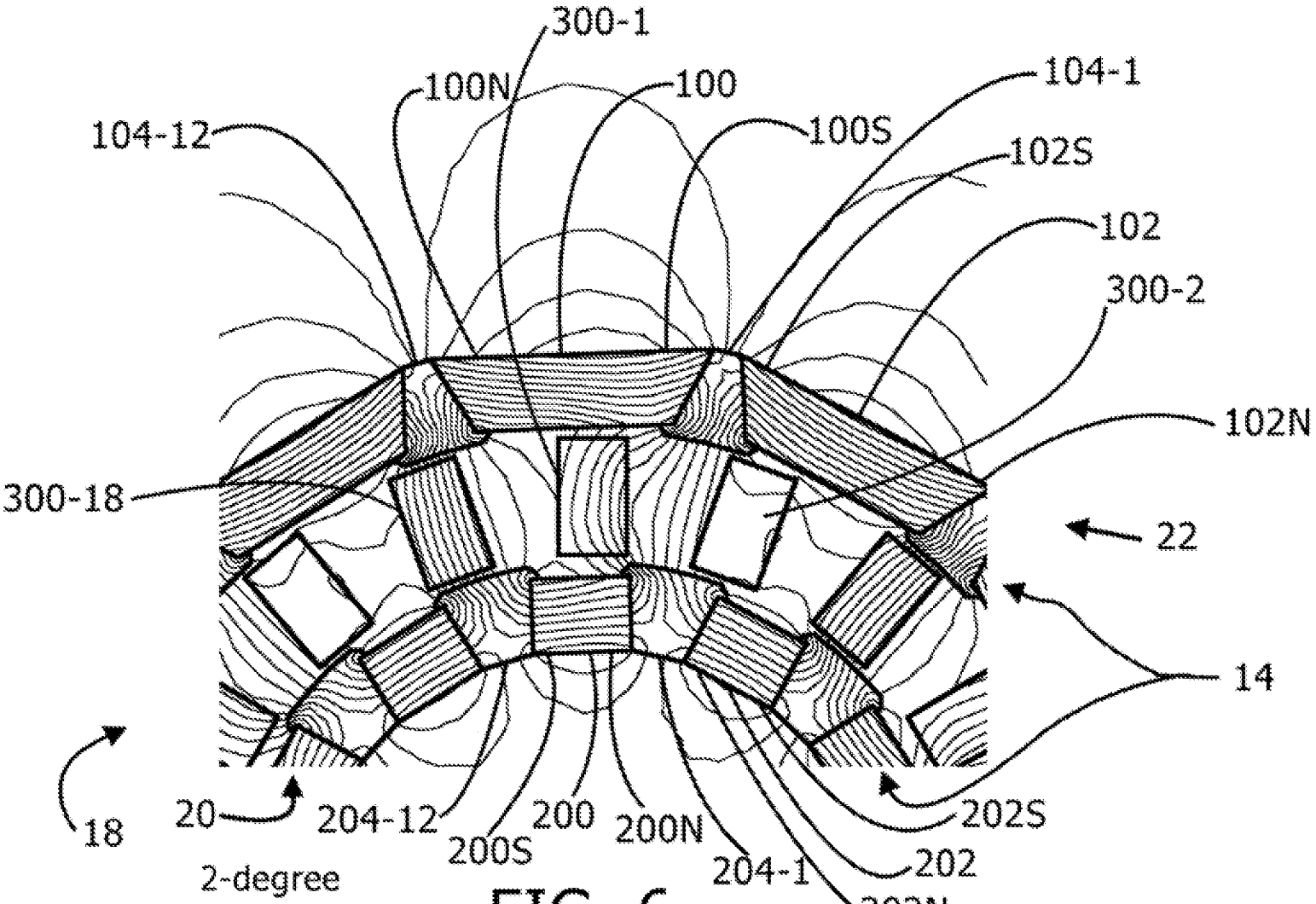
FIG. 6 is another view of the schematizied view of FIG. 5 with the rotor having advanced by 2 degrees from that shown in FIG. 5.
Figure 7:
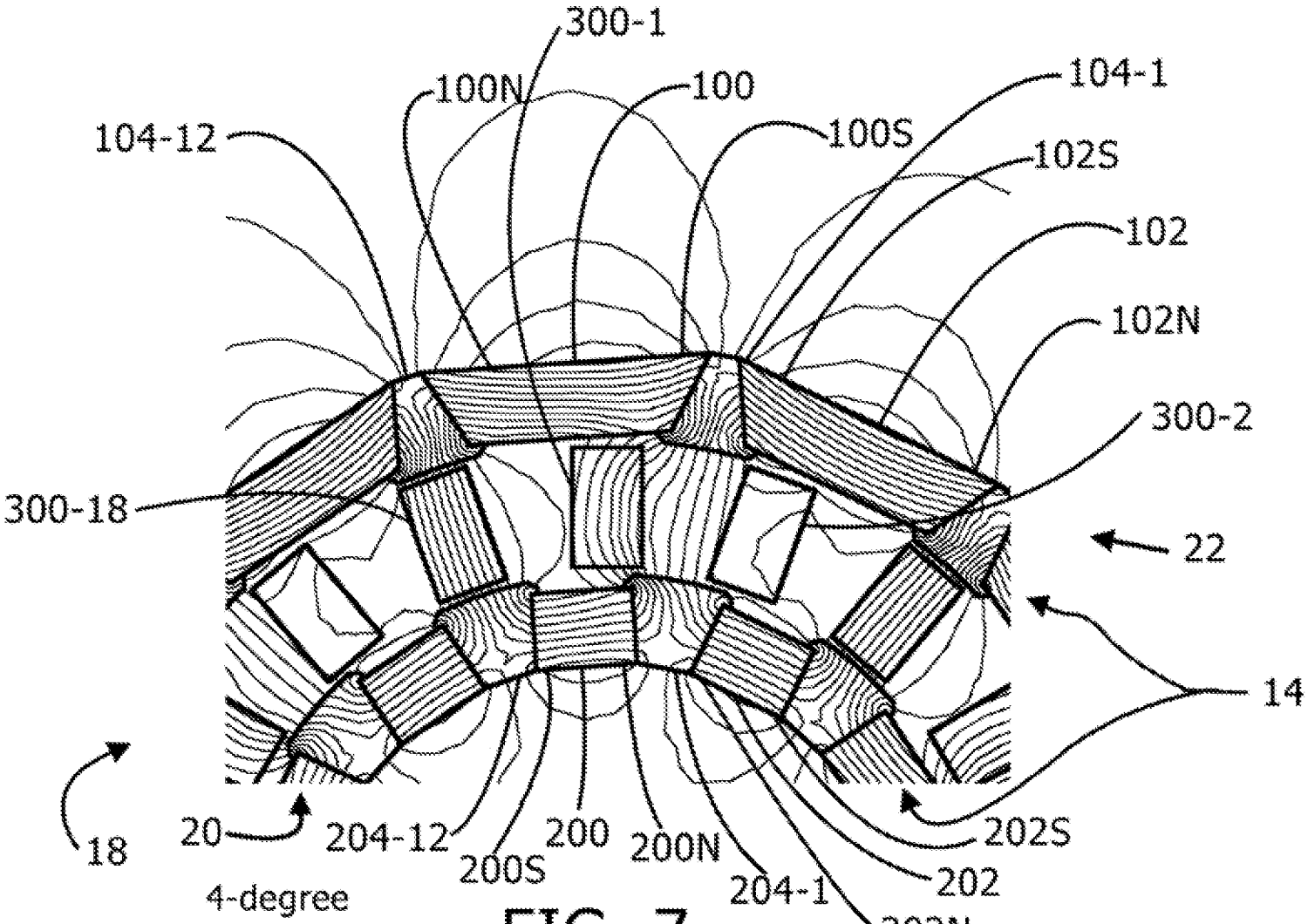
FIG. 7 is another view of the schematizied view of FIG. 5 with the rotor having advanced by 4 degrees from that shown in FIG. 5.
Figure 8:
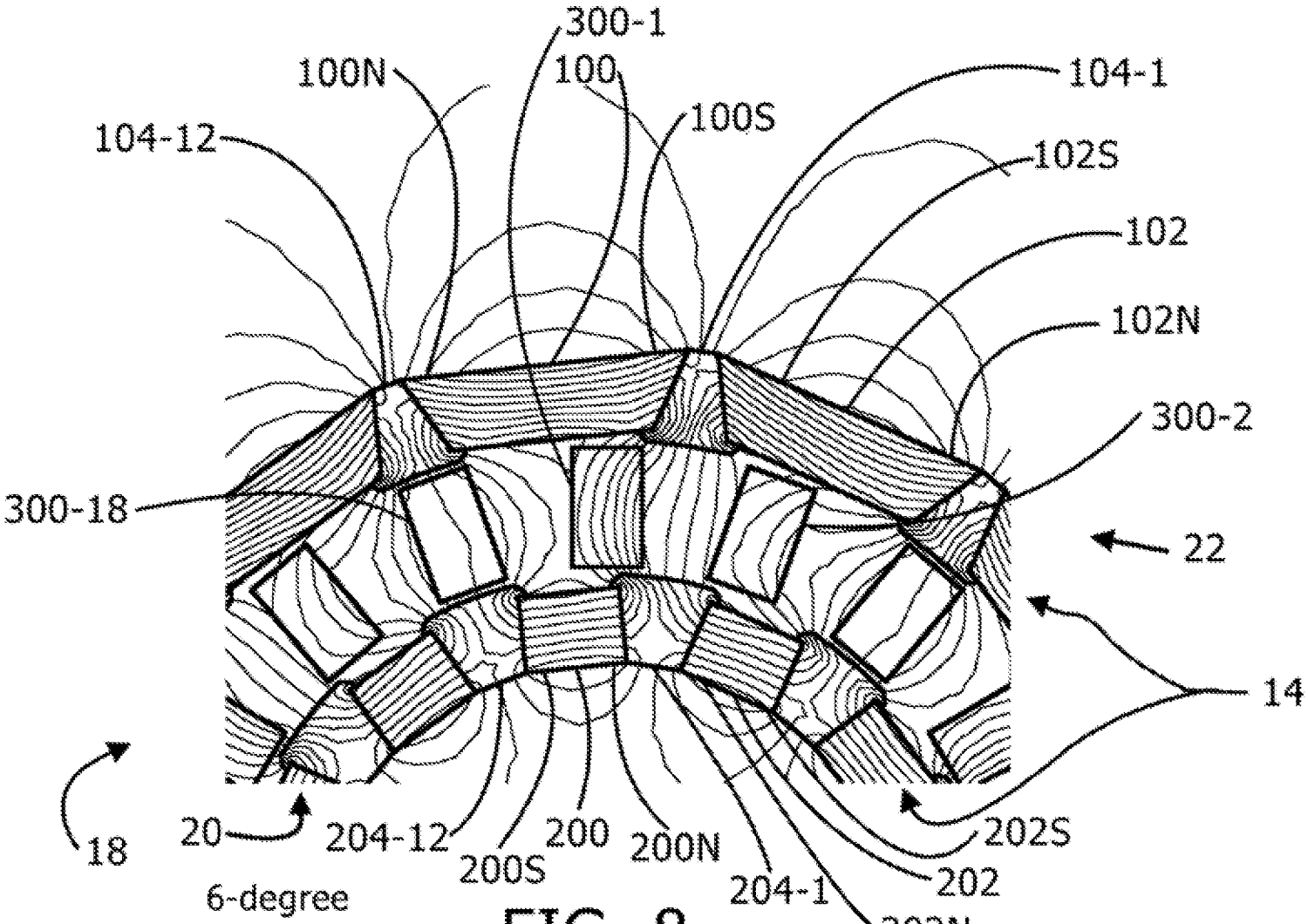
FIG. 8 is another view of the schematizied view of FIG. 5 with the rotor having advanced by 6 degrees from that shown in FIG. 5.
Figure 9:
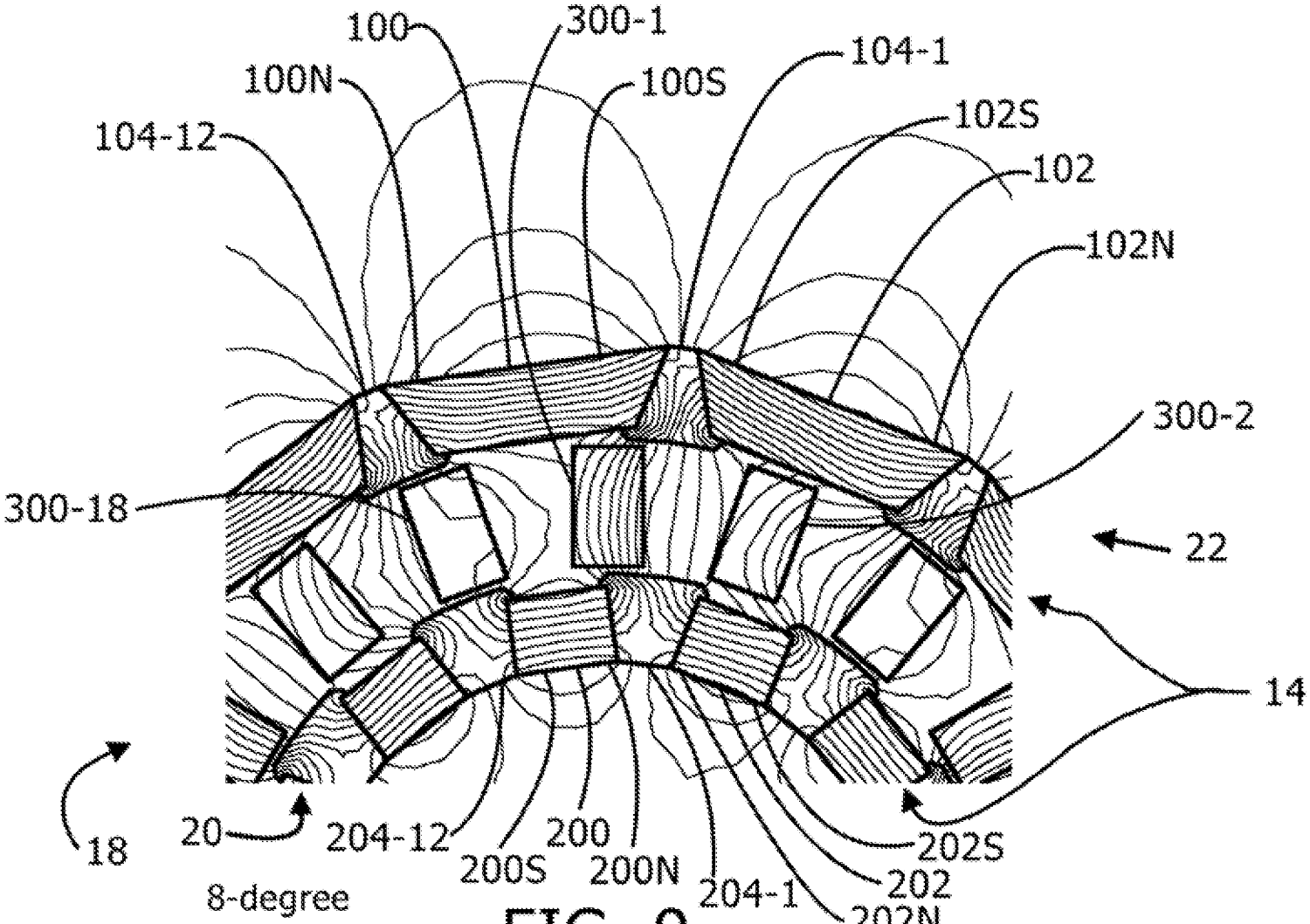
FIG. 9 is another view of the schematizied view of FIG. 5 with the rotor having advanced by 8 degrees from that shown in FIG. 5.
Figure 10:
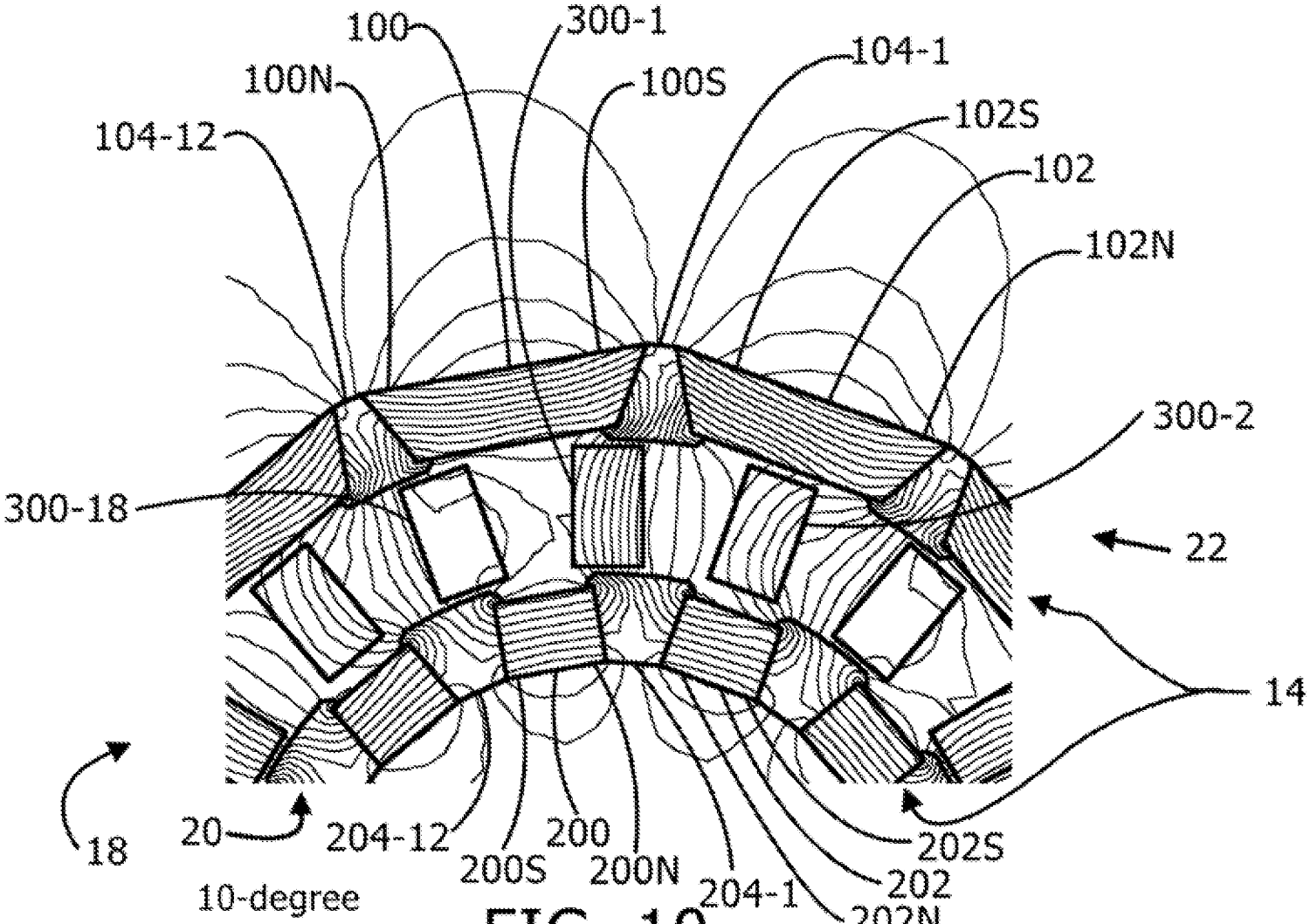
FIG. 10 is another view of the schematizied view of FIG. 5 with the rotor having advanced by 10 degrees from that shown in FIG. 5.
Figure 11:
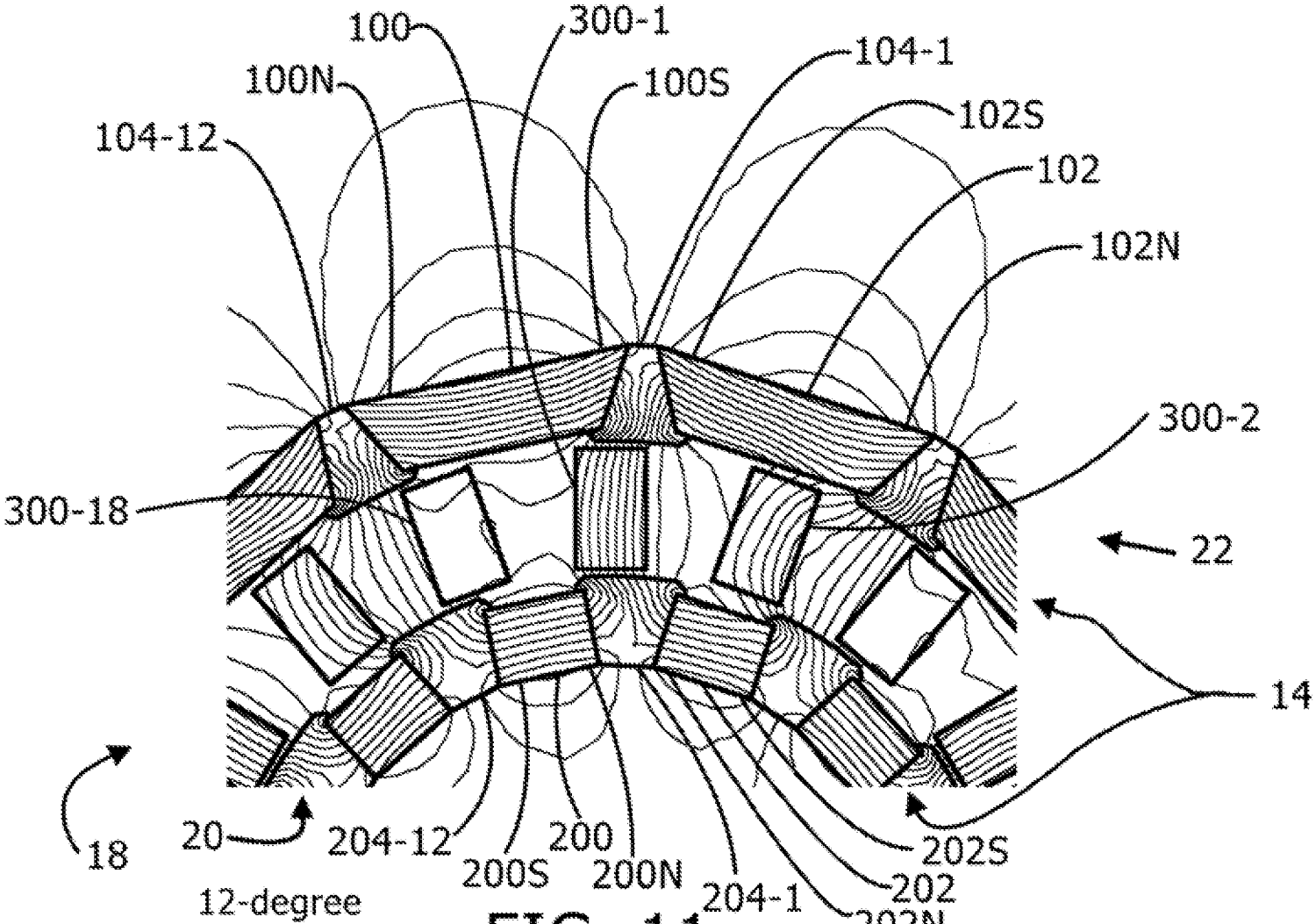
FIG. 11 is another view of the schematizied view of FIG. 5 with the rotor having advanced by 12 degrees from that shown in FIG. 5.

Now, additionally referring to FIG. 5 there is shown a closer view of a portion of the illustration in FIG. 4, with the addition of magnetic flux lines being shown. In FIGS. 6-35 there is illustrated a sequence of movements of rotor 14 relative to stator 18 in two degree increments.

In this discussion the primary focus is what is happing relative to electromagnetic member 300-1. While some discussion of adjacent magnetic members 300 may occur what happens in each of the members 300 is similar, but they happen at differing timings since there are, in this illustration, eighteen members 300, twelve members 104 and twelve members 204. Other ratios of members are also contemplated, but are not needed to explain the inventive nature of the present invention.

Electromagnetic member 300-1, in FIG. 5 has an increasing magnetic flux density as rotor 14 is moving counterclockwise in direction RD. The magnetic polarity of member 300-1 is with a north magnetic polarity at the top and a south magnetic polarity at the bottom. This serves to repel both ferrous members 104-12 and 204-12 away from member 300-1 and to attract ferrous members 104-1 and 204-1 as the magnetic flux that would exist between ferrous members 104-1 and 204-1 is being drawn into member 300-1.

Figure 12:
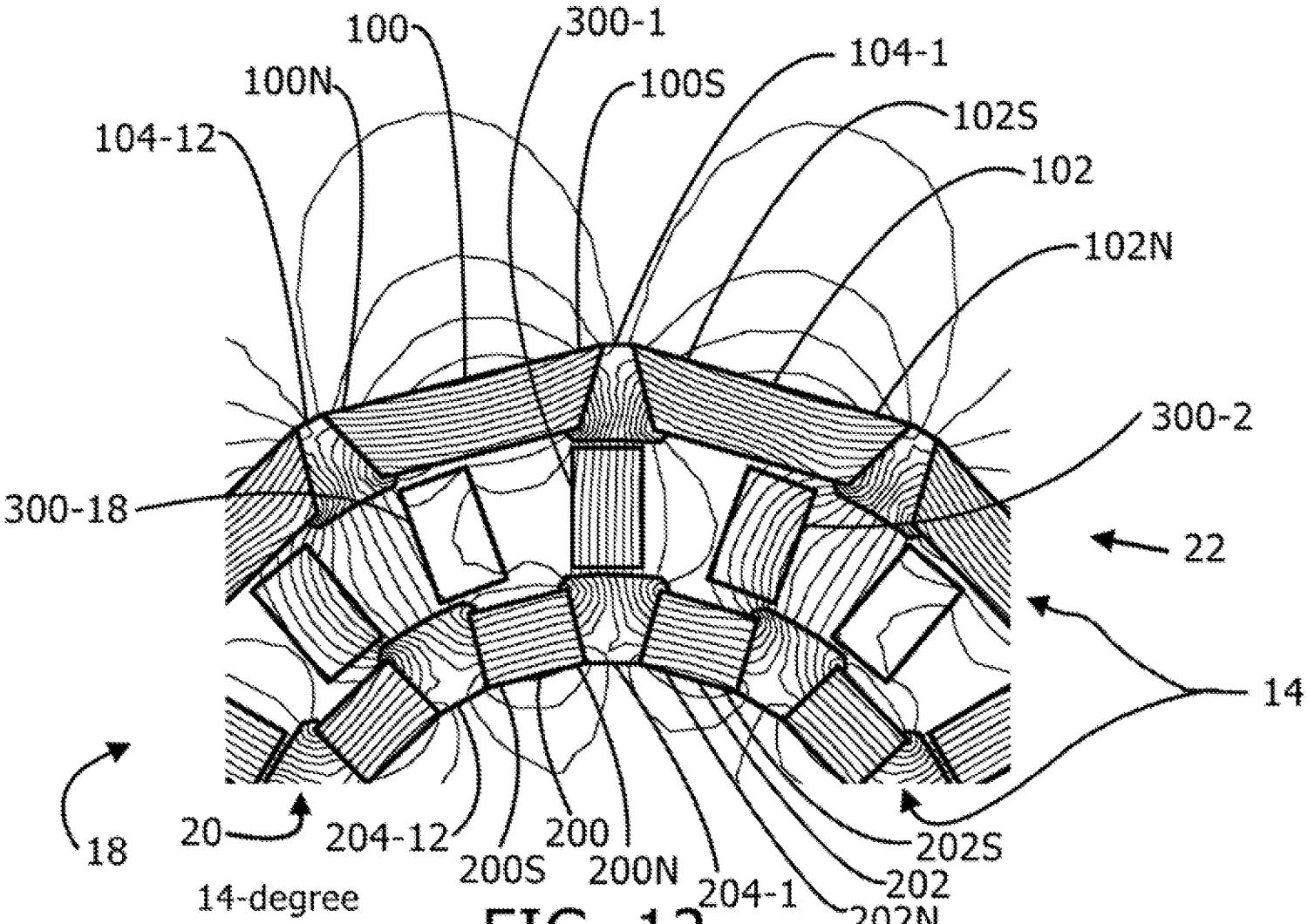
FIG. 12 is another view of the schematizied view of FIG. 5 with the rotor having advanced by 14 degrees from that shown in FIG. 5.
Figure 13:
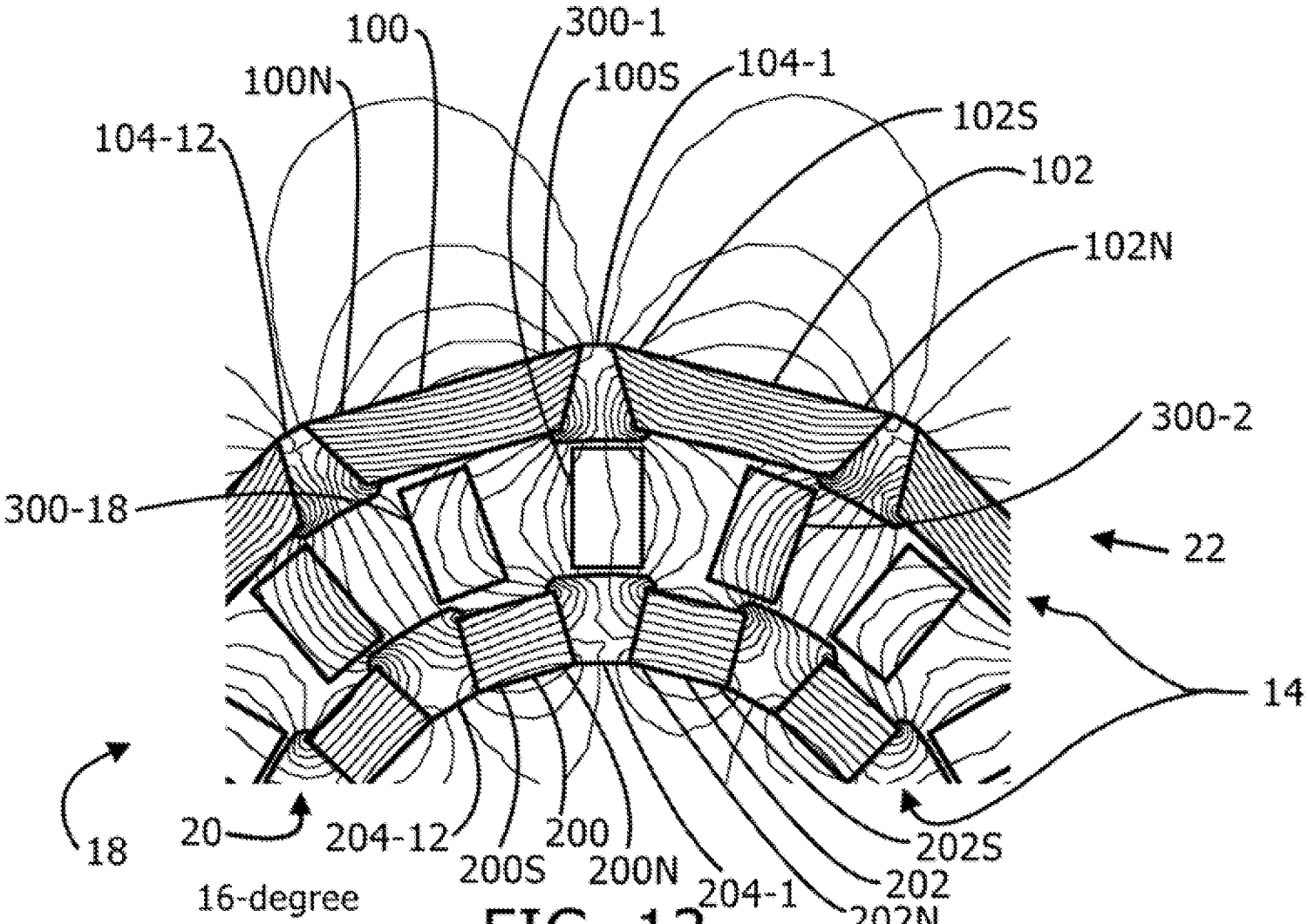
FIG. 13 is another view of the schematizied view of FIG. 5 with the rotor having advanced by 16 degrees from that shown in FIG. 5.
Figure 14:
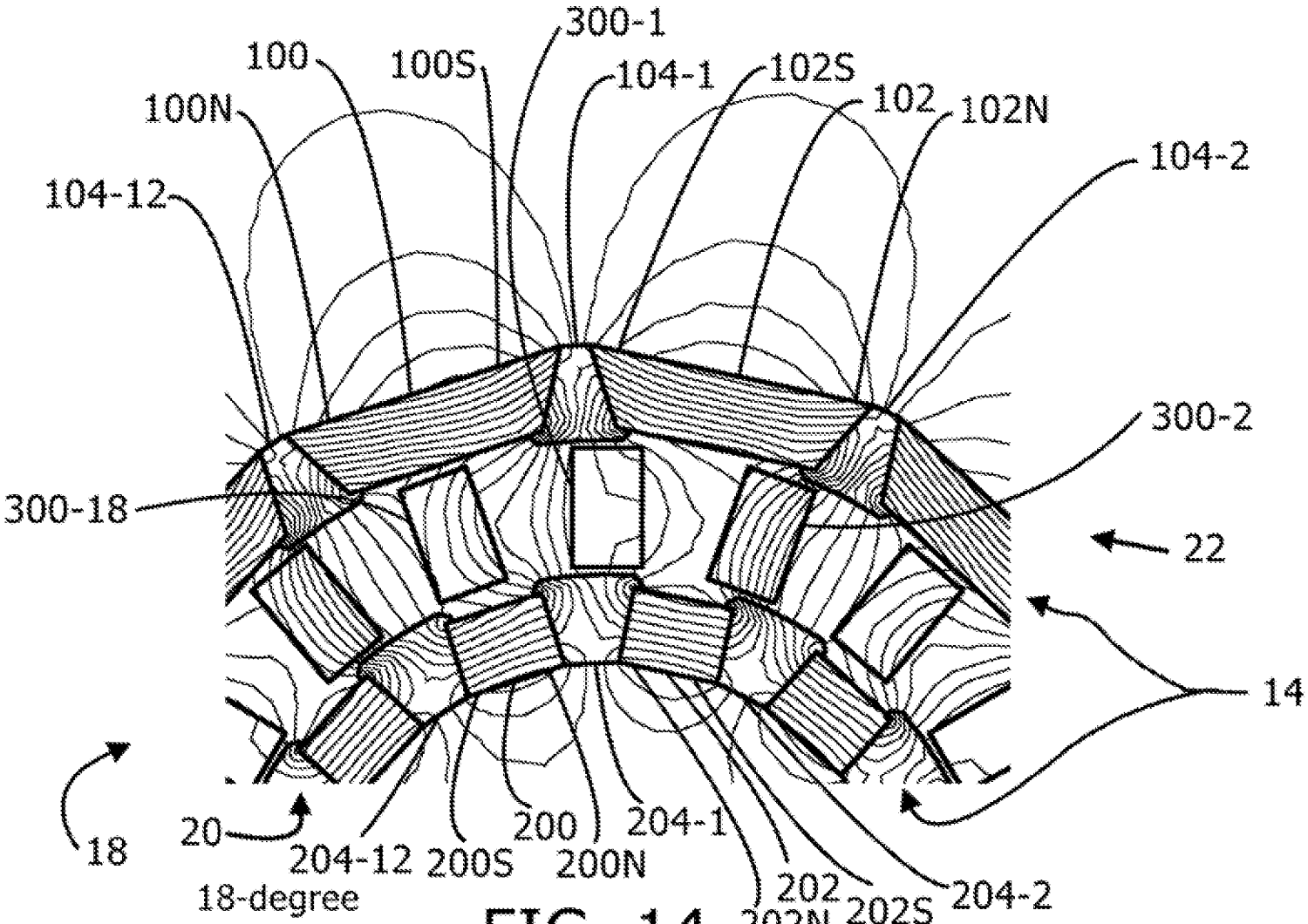
FIG. 14 is another view of the schematizied view of FIG. 5 with the rotor having advanced by 18 degrees from that shown in FIG. 5.
Figure 15:
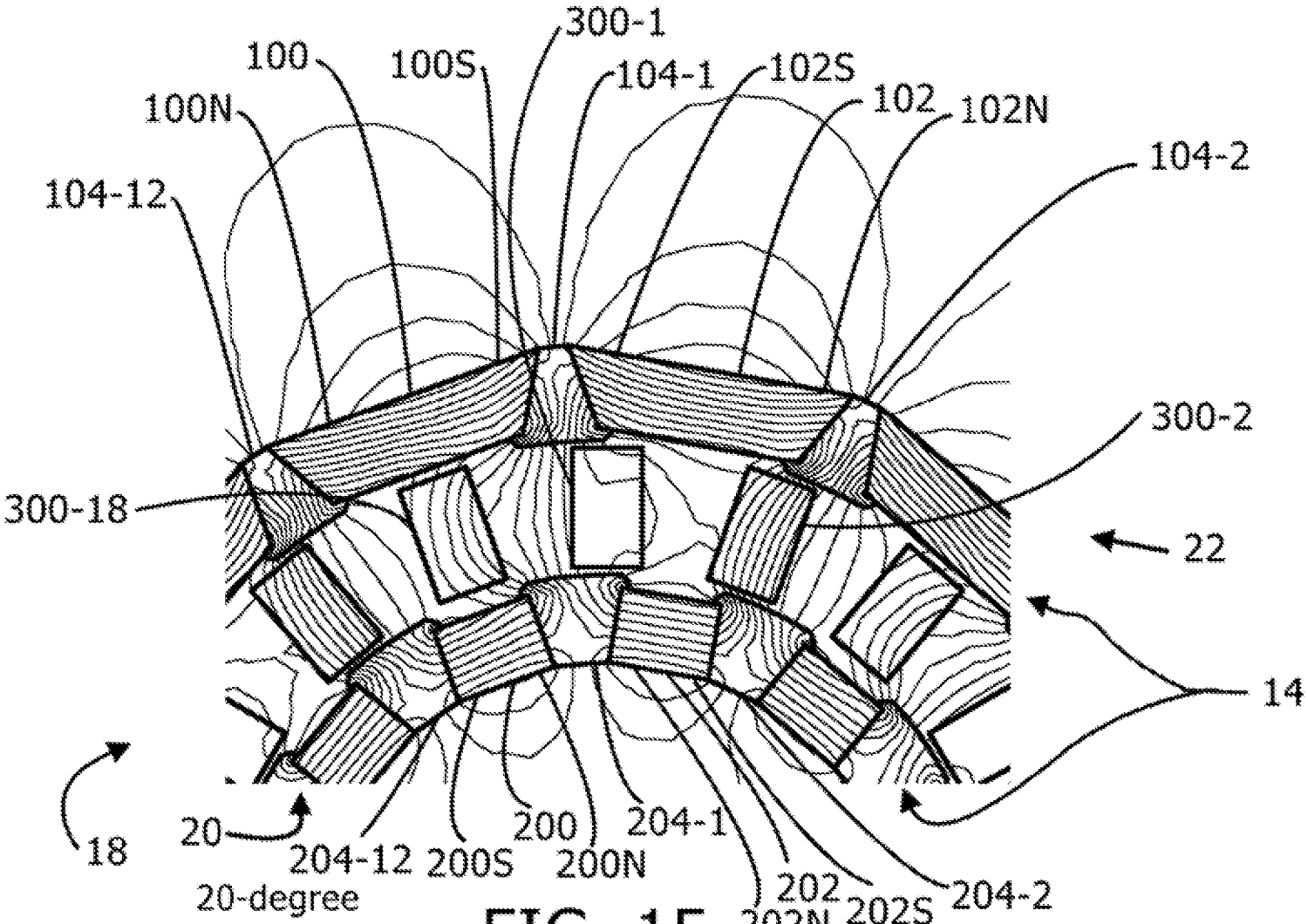
FIG. 15 is another view of the schematizied view of FIG. 5 with the rotor having advanced by 20 degrees from that shown in FIG. 5.
Figure 16:
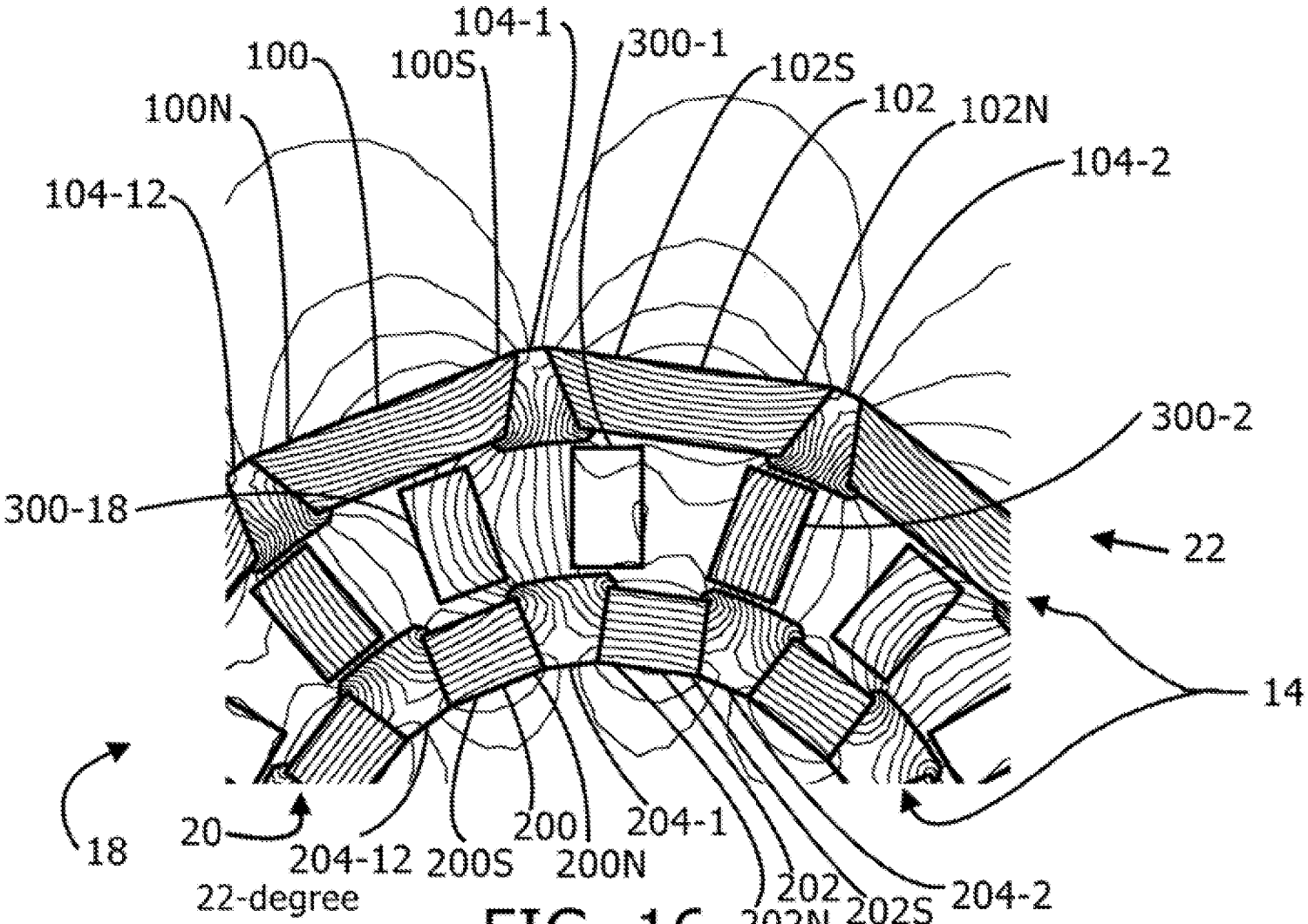
FIG. 16 is another view of the schematizied view of FIG. 5 with the rotor having advanced by 22 degrees from that shown in FIG. 5.
Figure 17:
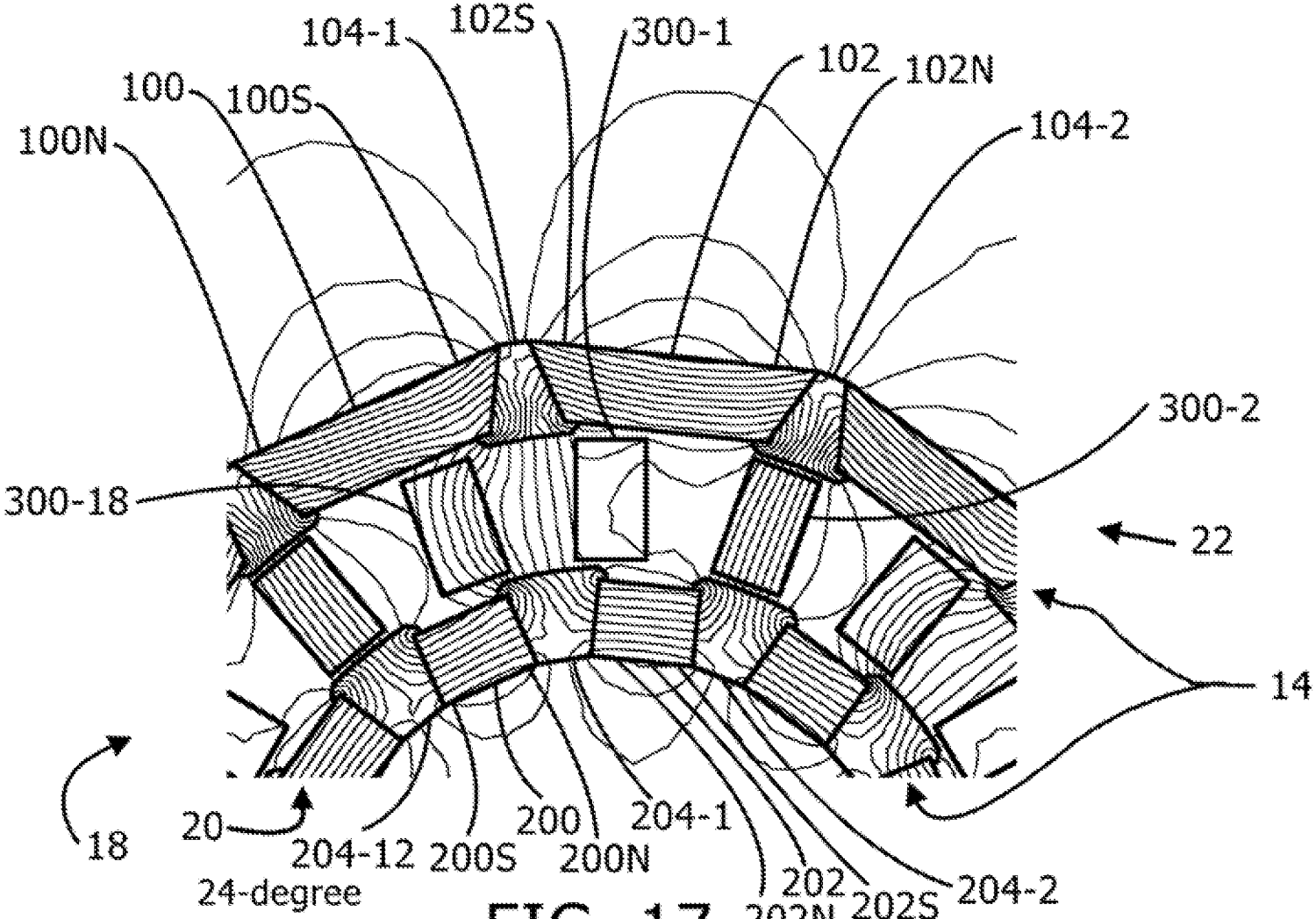
FIG. 17 is another view of the schematizied view of FIG. 5 with the rotor having advanced by 24 degrees from that shown in FIG. 5.

In FIGS. 6-12, the magnetic flux density continues to increase in electromagnetic member 300-1 as nearly the entire magnetic flux from ferrous members 104-1 and 204-1 now passes through member 300-1, in FIG. 12. In FIG. 13 we see that the magnetic polarity of member 300-1 has been switched so that the top is now S and the bottom is N, rapidly driving the magnetic flux away from member 300-1 that had been flowing therethrough from ferrous members 104-1 and 204-1. This serves then to strongly repel members 104-1 and 204-1 driving them to the left causing the counterclockwise motion of rotor 14 to continue.

Figure 18:
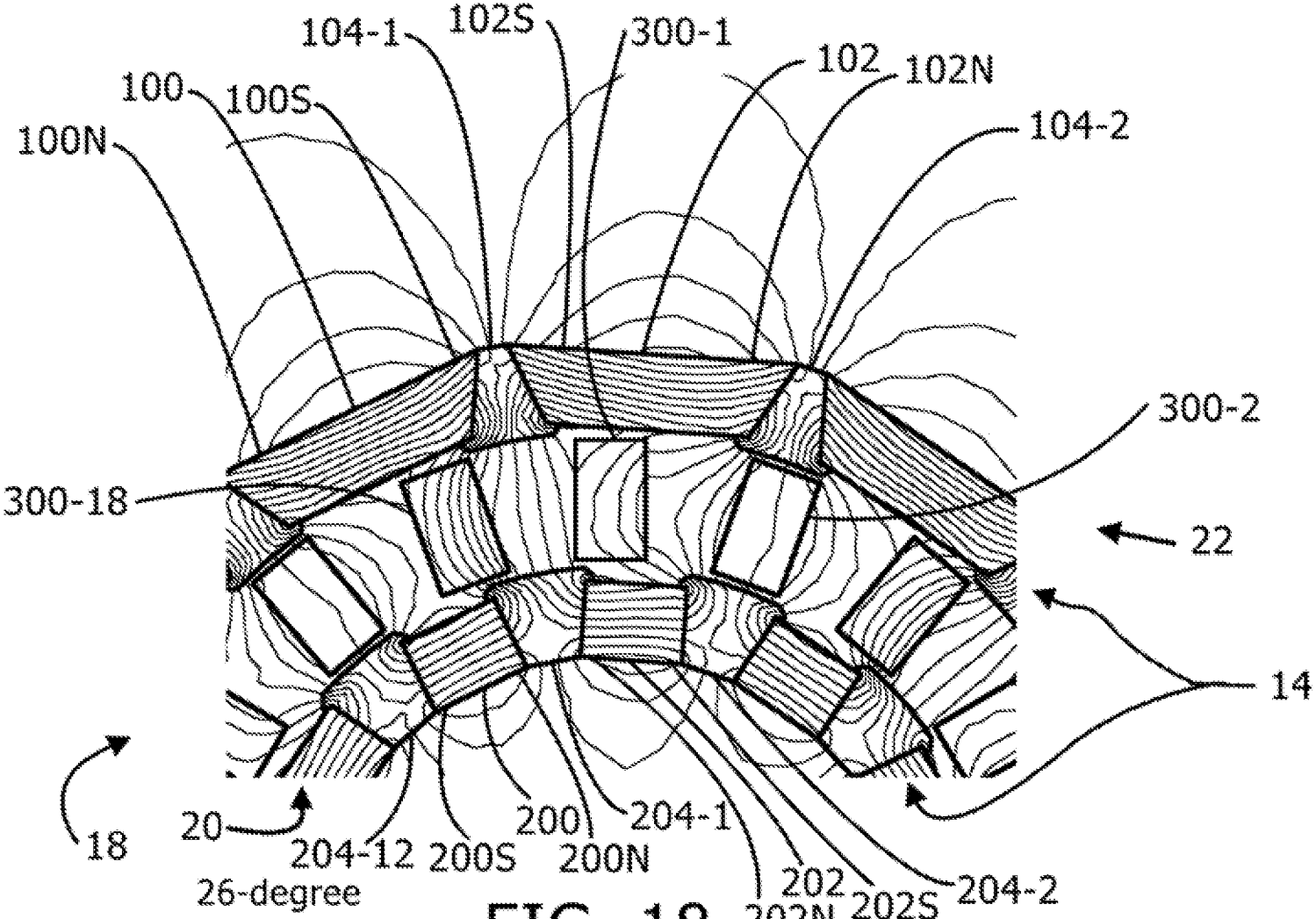
FIG. 18 is another view of the schematizied view of FIG. 5 with the rotor having advanced by 26 degrees from that shown in FIG. 5.
Figure 19:
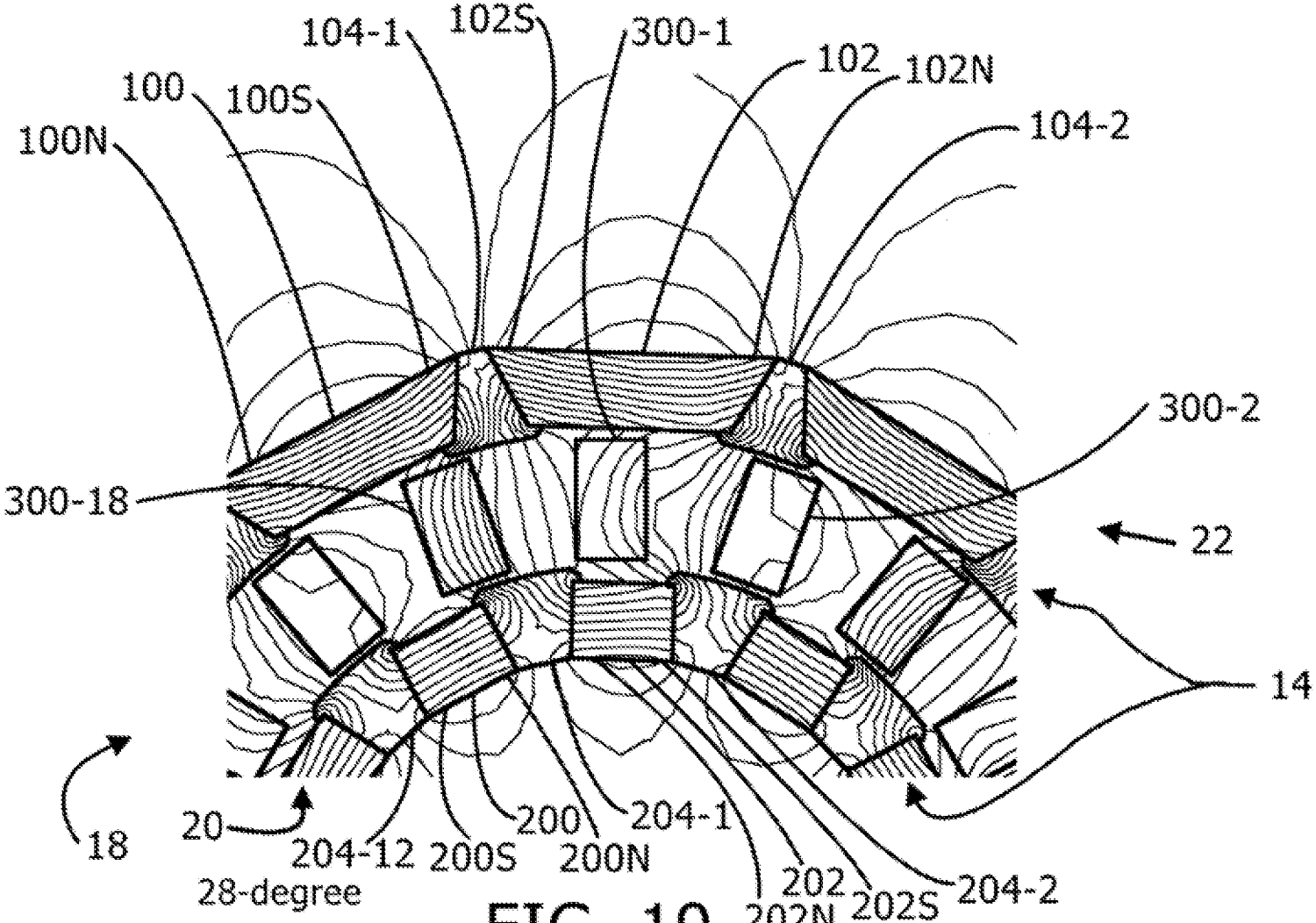
FIG. 19 is another view of the schematizied view of FIG. 5 with the rotor having advanced by 28 degrees from that shown in FIG. 5.
Figure 20:
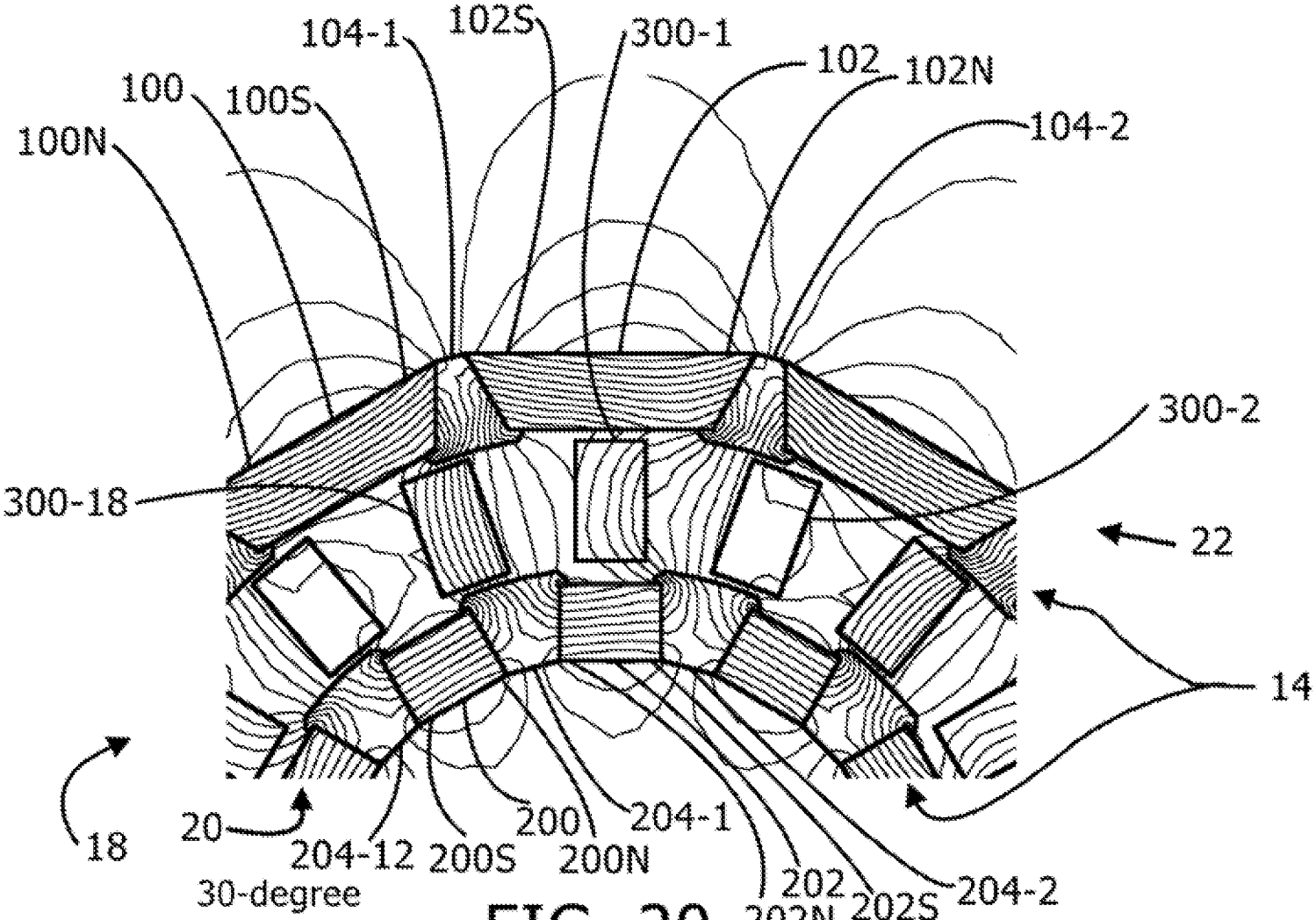
FIG. 20 is another view of the schematizied view of FIG. 5 with the rotor having advanced by 30 degrees from that shown in FIG. 5.
Figure 21:
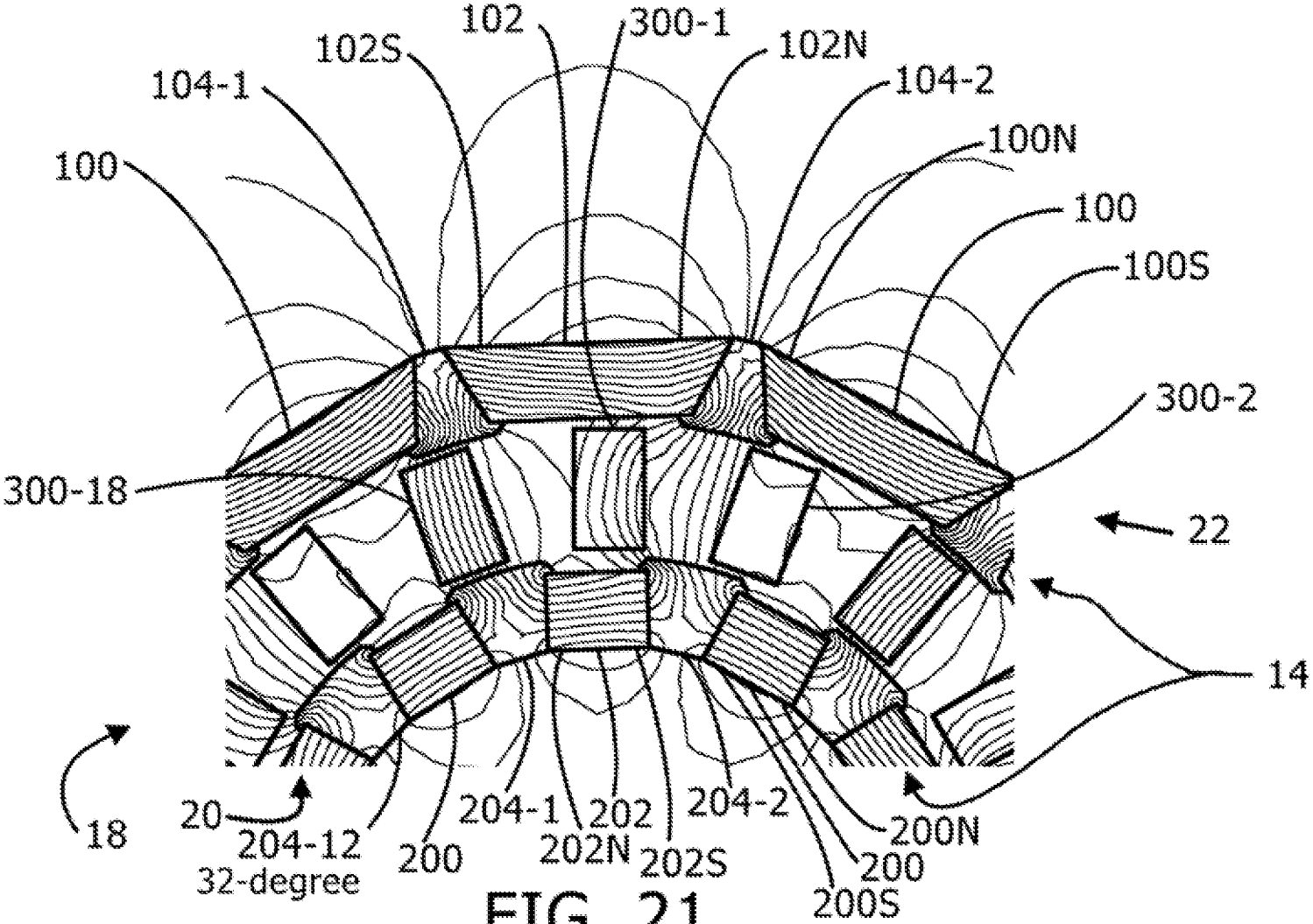
FIG. 21 is another view of the schematizied view of FIG. 5 with the rotor having advanced by 32 degrees from that shown in FIG. 5.
Figure 22:
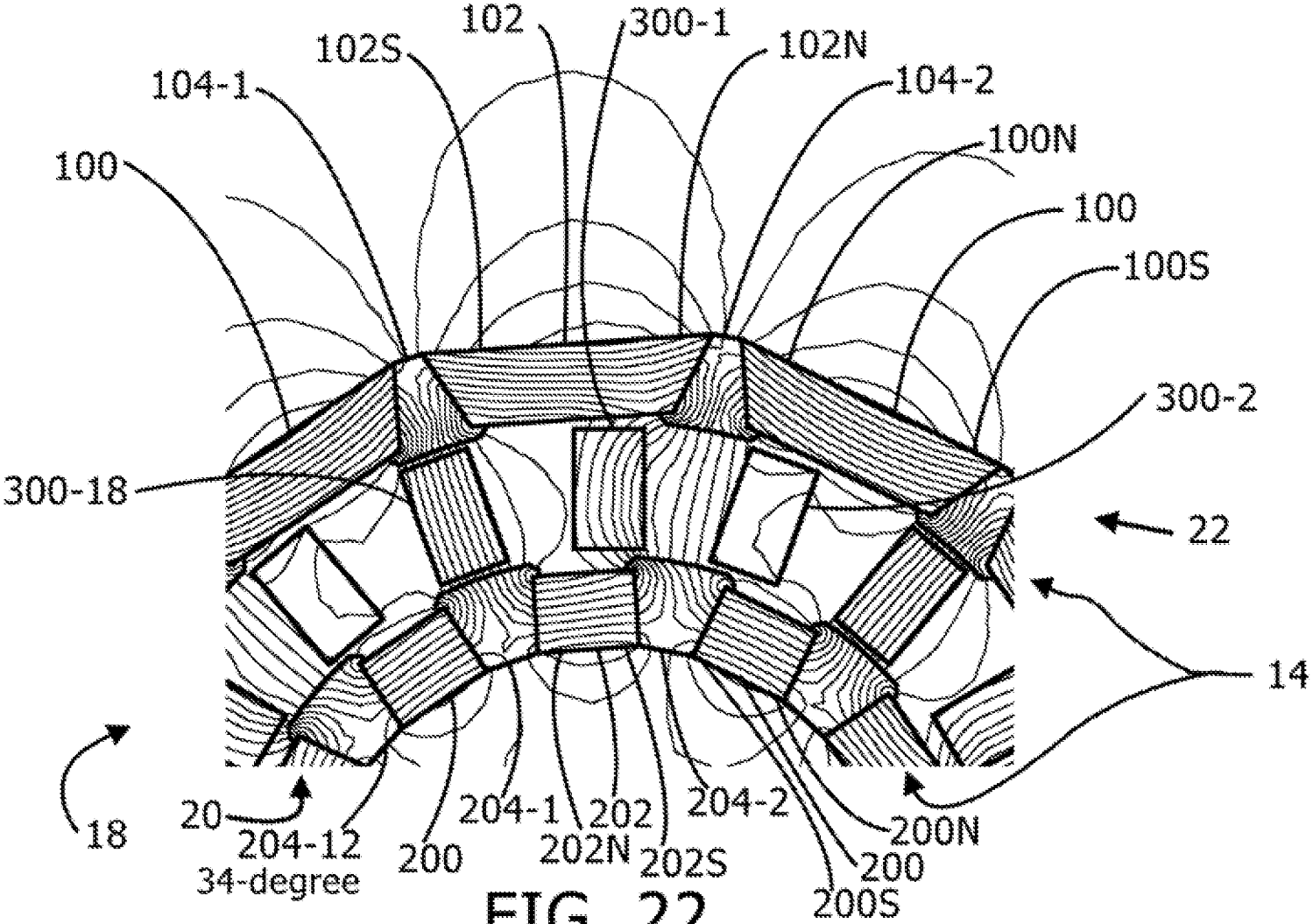
FIG. 22 is another view of the schematizied view of FIG. 5 with the rotor having advanced by 34 degrees from that shown in FIG. 5.
Figure 23:
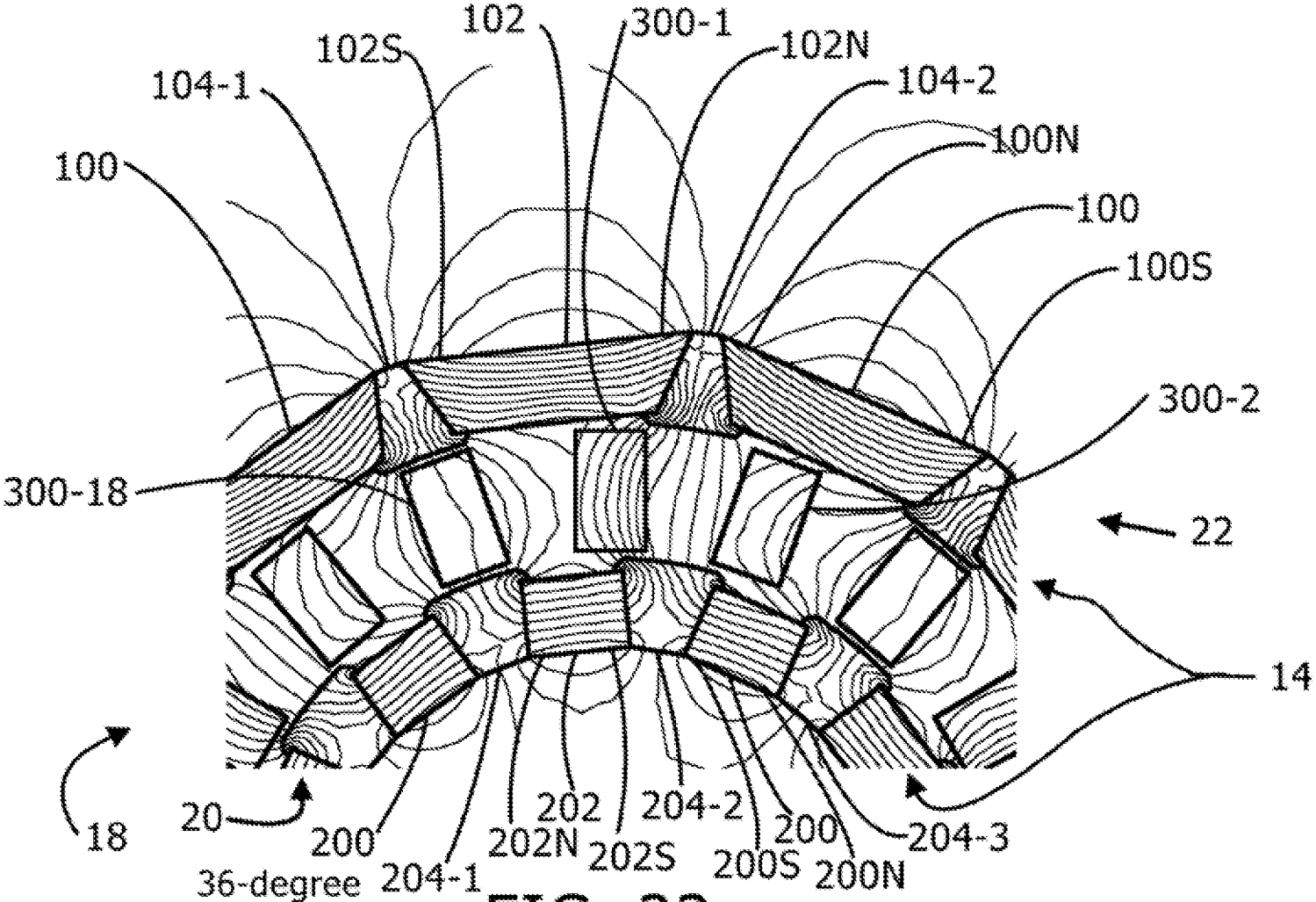
FIG. 23 is another view of the schematizied view of FIG. 5 with the rotor having advanced by 36 degrees from that shown in FIG. 5.
Figure 24:
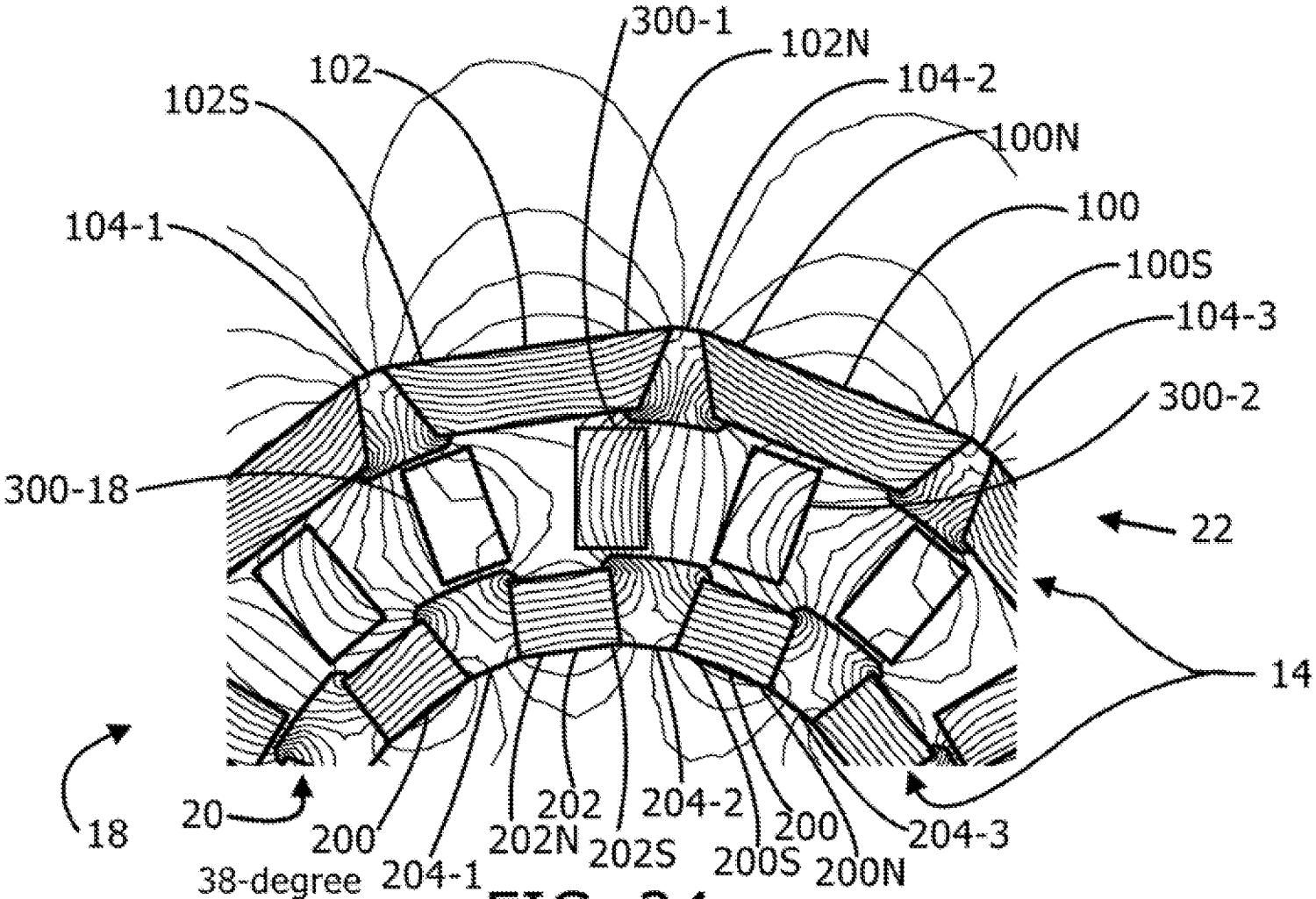
FIG. 24 is another view of the schematizied view of FIG. 5 with the rotor having advanced by 38 degrees from that shown in FIG. 5.
Figure 25:
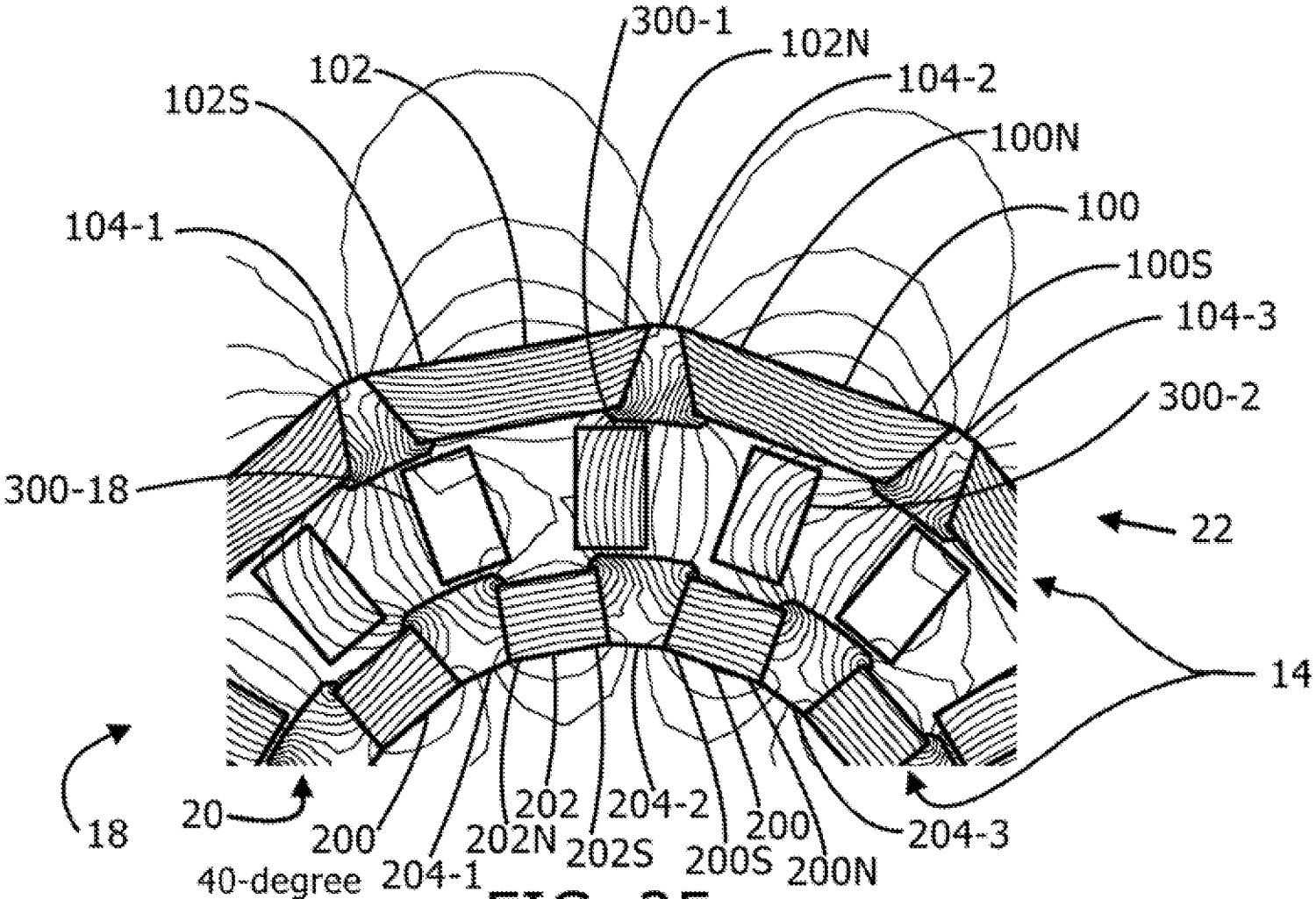
FIG. 25 is another view of the schematizied view of FIG. 5 with the rotor having advanced by 40 degrees from that shown in FIG. 5.
Figure 26:
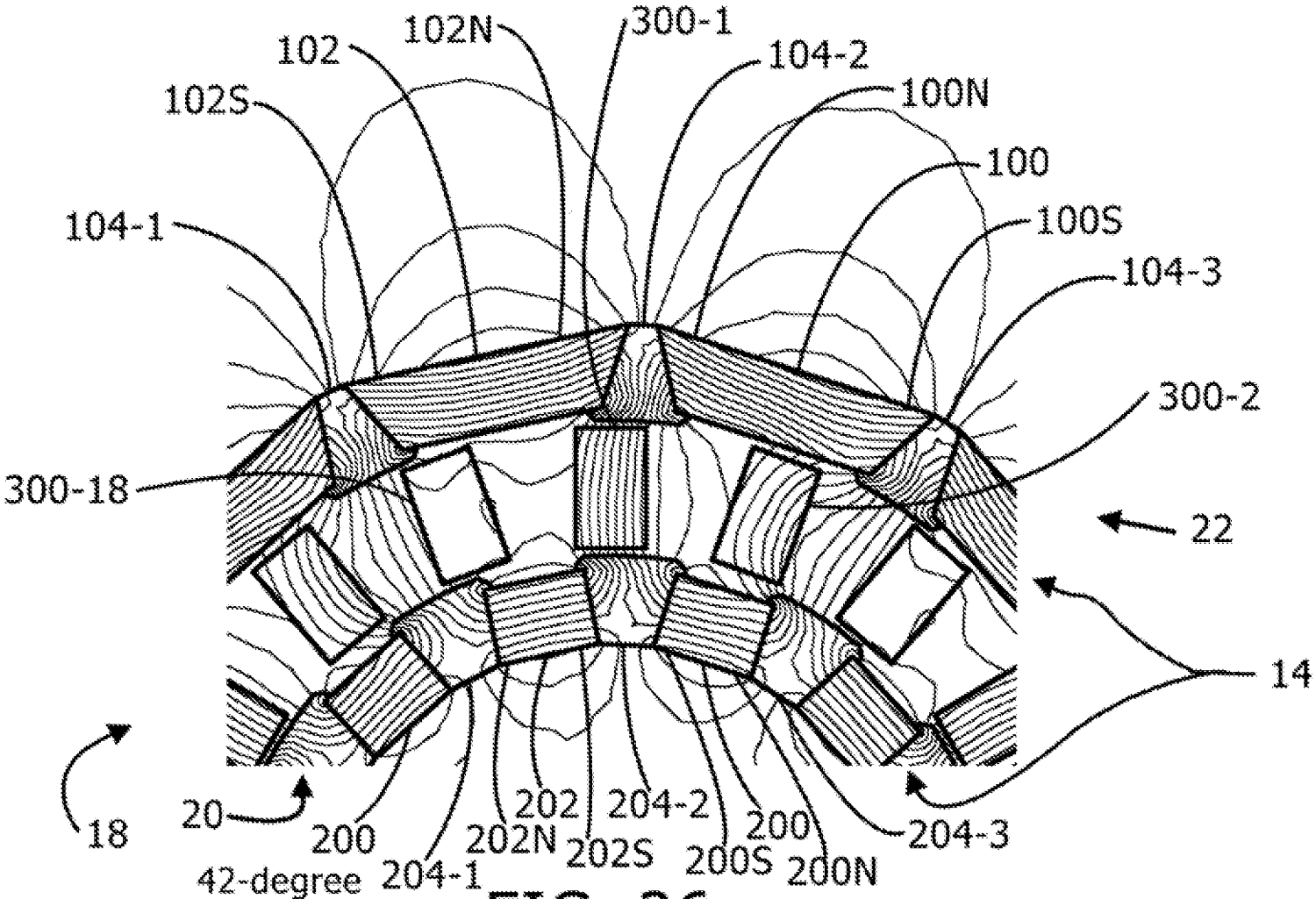
FIG. 26 is another view of the schematizied view of FIG. 5 with the rotor having advanced by 42 degrees from that shown in FIG. 5.
Figure 27:
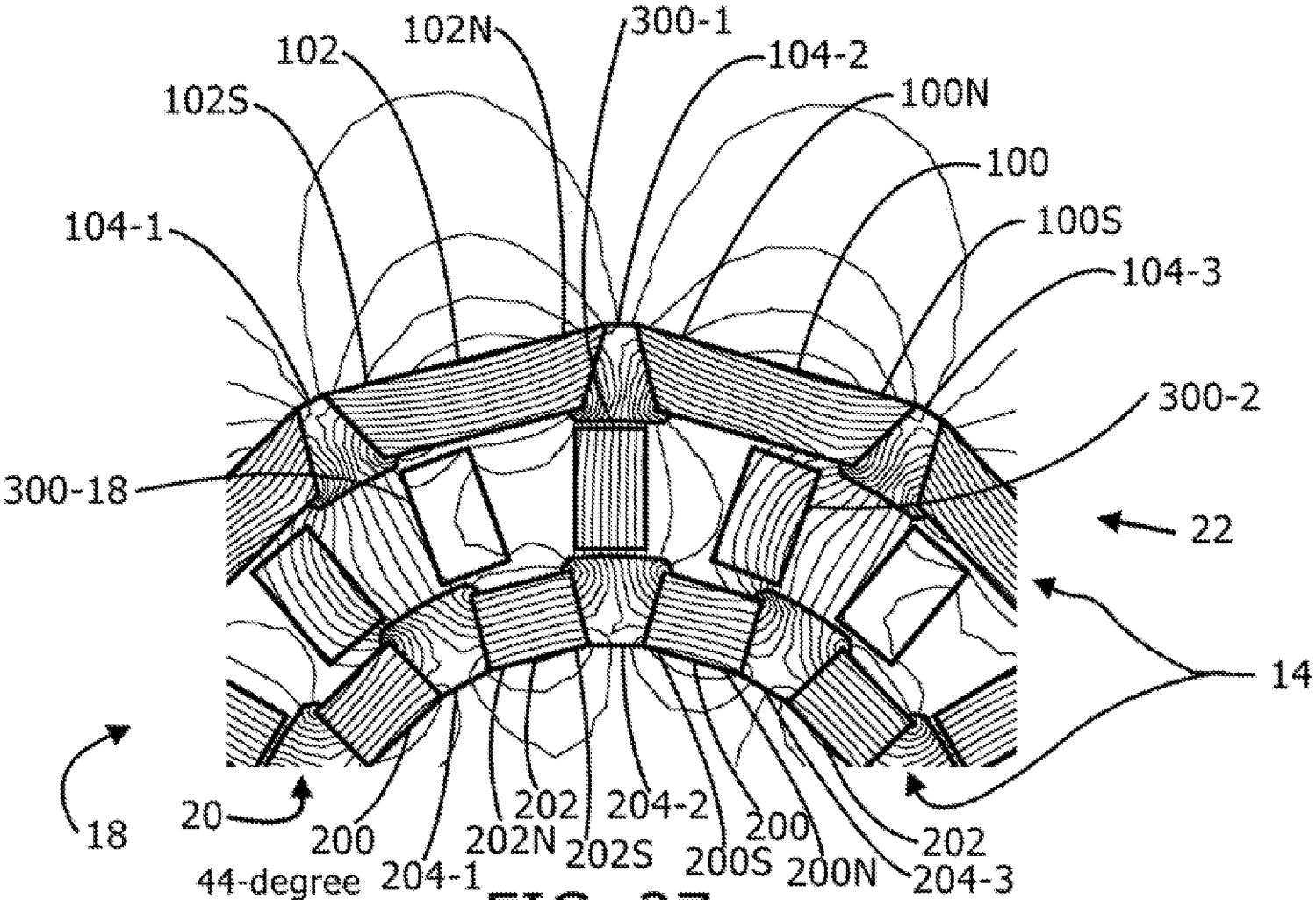
FIG. 27 is another view of the schematizied view of FIG. 5 with the rotor having advanced by 44 degrees from that shown in FIG. 5.

In FIGS. 14-17 it can be seen that rotor 14 continues to move counterclockwise with electromagnetic member 300-1 repelling the magnetic field from ferrous members 104-1 and 204-1. In FIG. 18 member 300-1 is shown as now attracting ferrous members 104-2 and 204-2 as some of the magnetic flux therefrom is now passing through member 300-1. This happens rapidly, as seen in the difference between FIGS. 17 and 18, because electromagnetic member 300-2 has switched polarity driving the path of magnetic flux away from passing through member 300-2. In FIGS. 19-27, rotor 14 continues to move (approximately 16 degrees) as the magnetic flux density in member 300-1 continues to increase as the attraction between member 300-1 and members 104-2 and 204-2 continue to increase.

Figure 28:
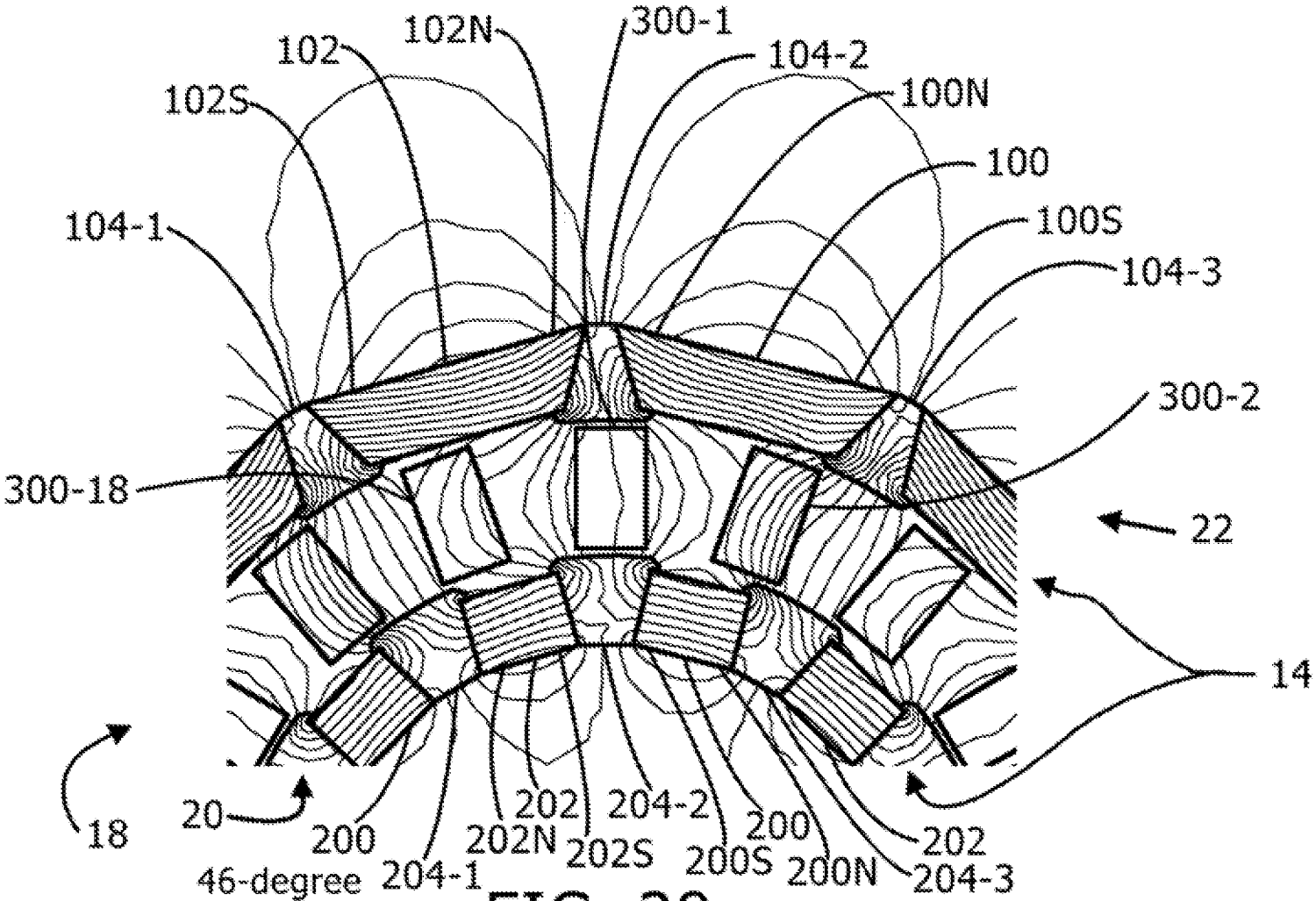
FIG. 28 is another view of the schematizied view of FIG. 5 with the rotor having advanced by 46 degrees from that shown in FIG. 5.
Figure 29:
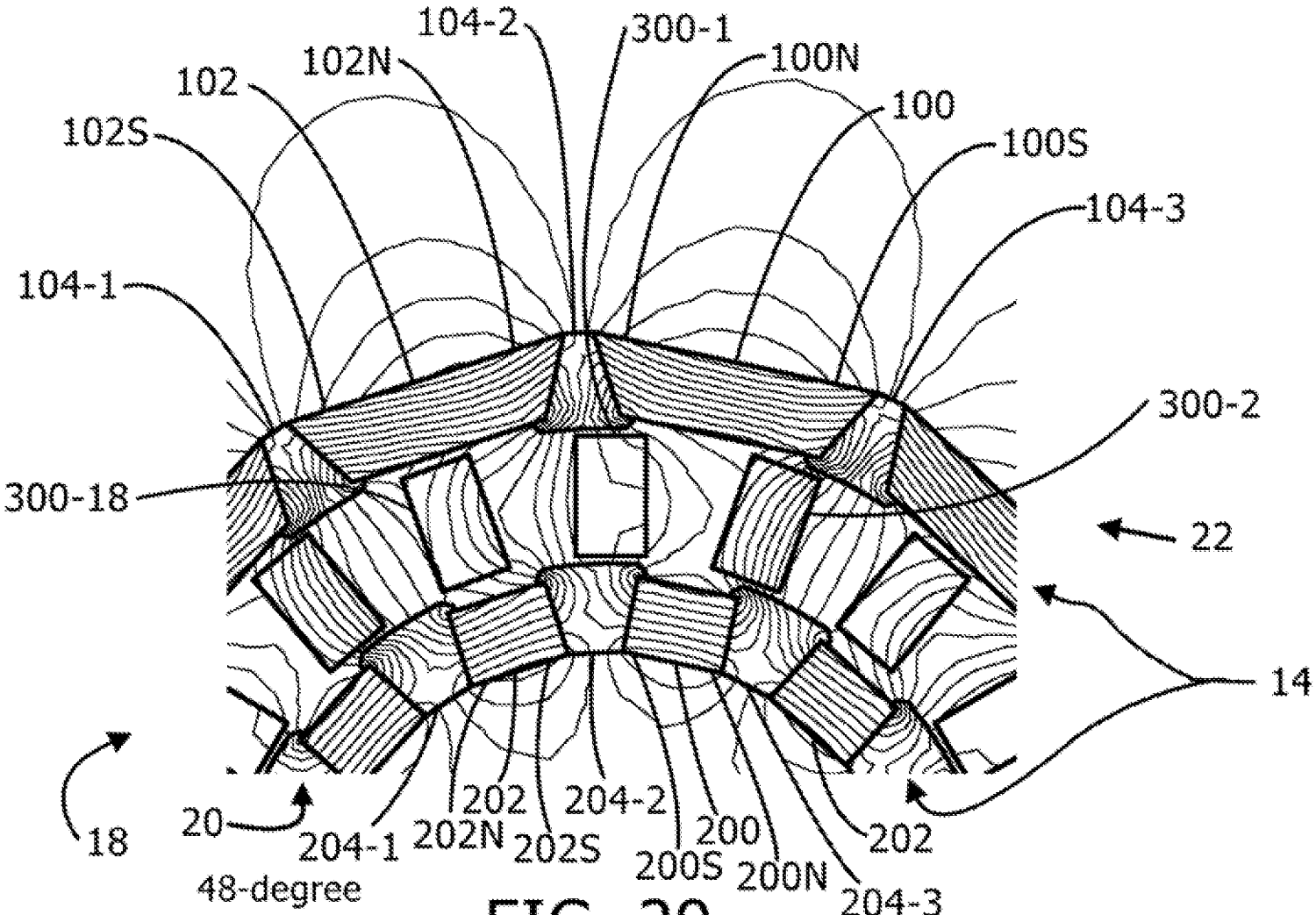
FIG. 29 is another view of the schematizied view of FIG. 5 with the rotor having advanced by 48 degrees from that shown in FIG. 5.
Figure 30:
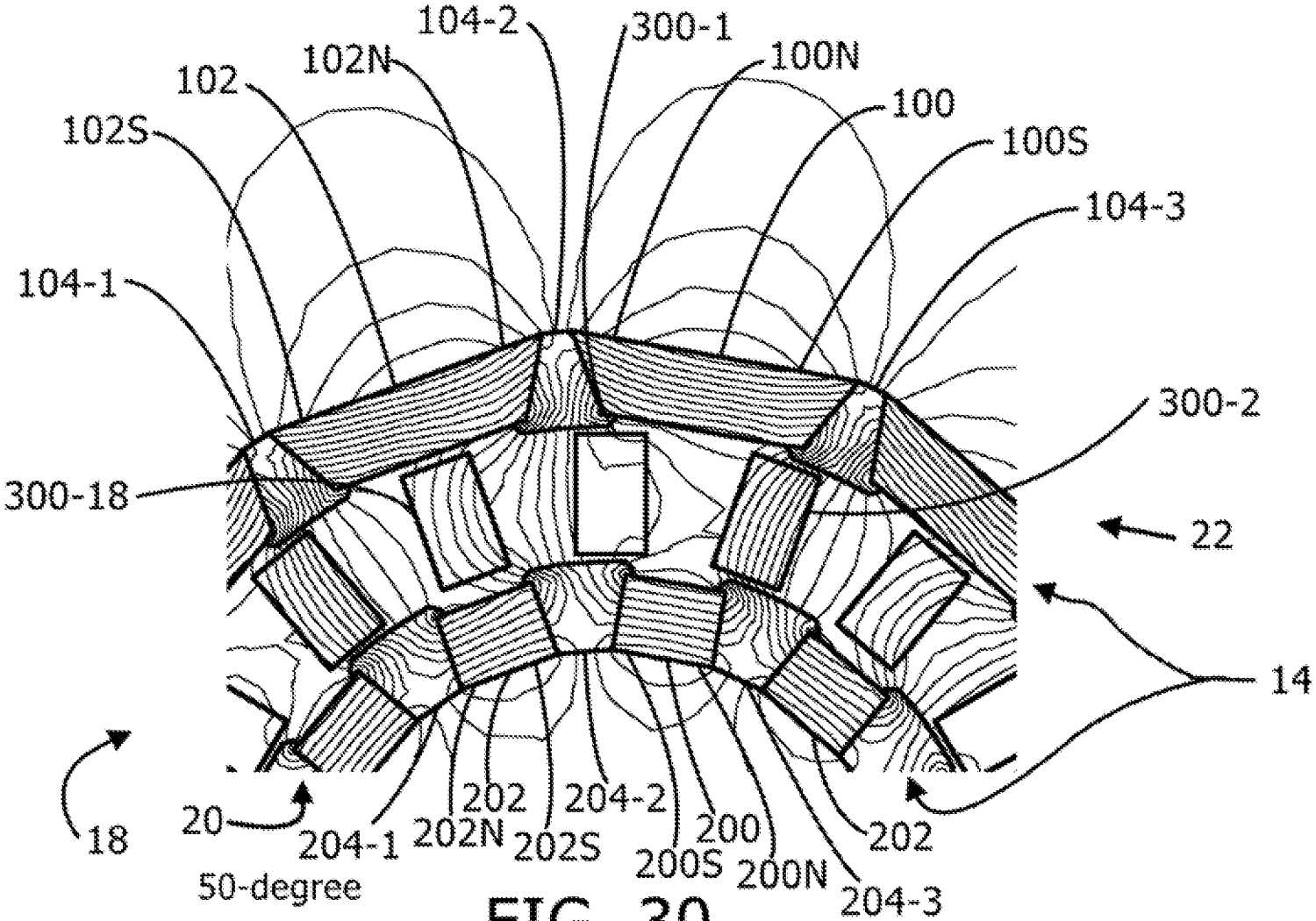
FIG. 30 is another view of the schematizied view of FIG. 5 with the rotor having advanced by 50 degrees from that shown in FIG. 5.
Figure 31:
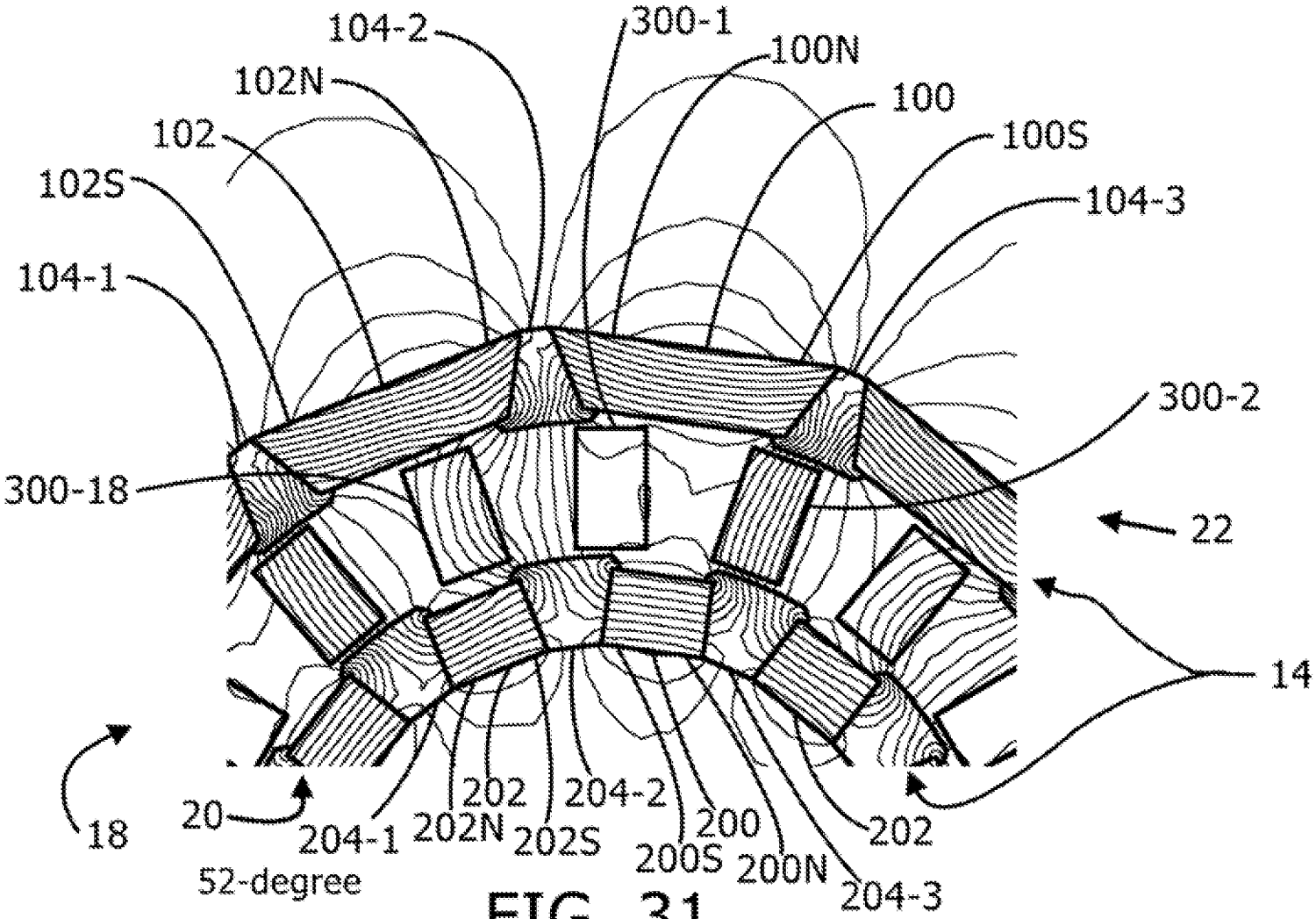
FIG. 31 is another view of the schematizied view of FIG. 5 with the rotor having advanced by 52 degrees from that shown in FIG. 5.
Figure 32:
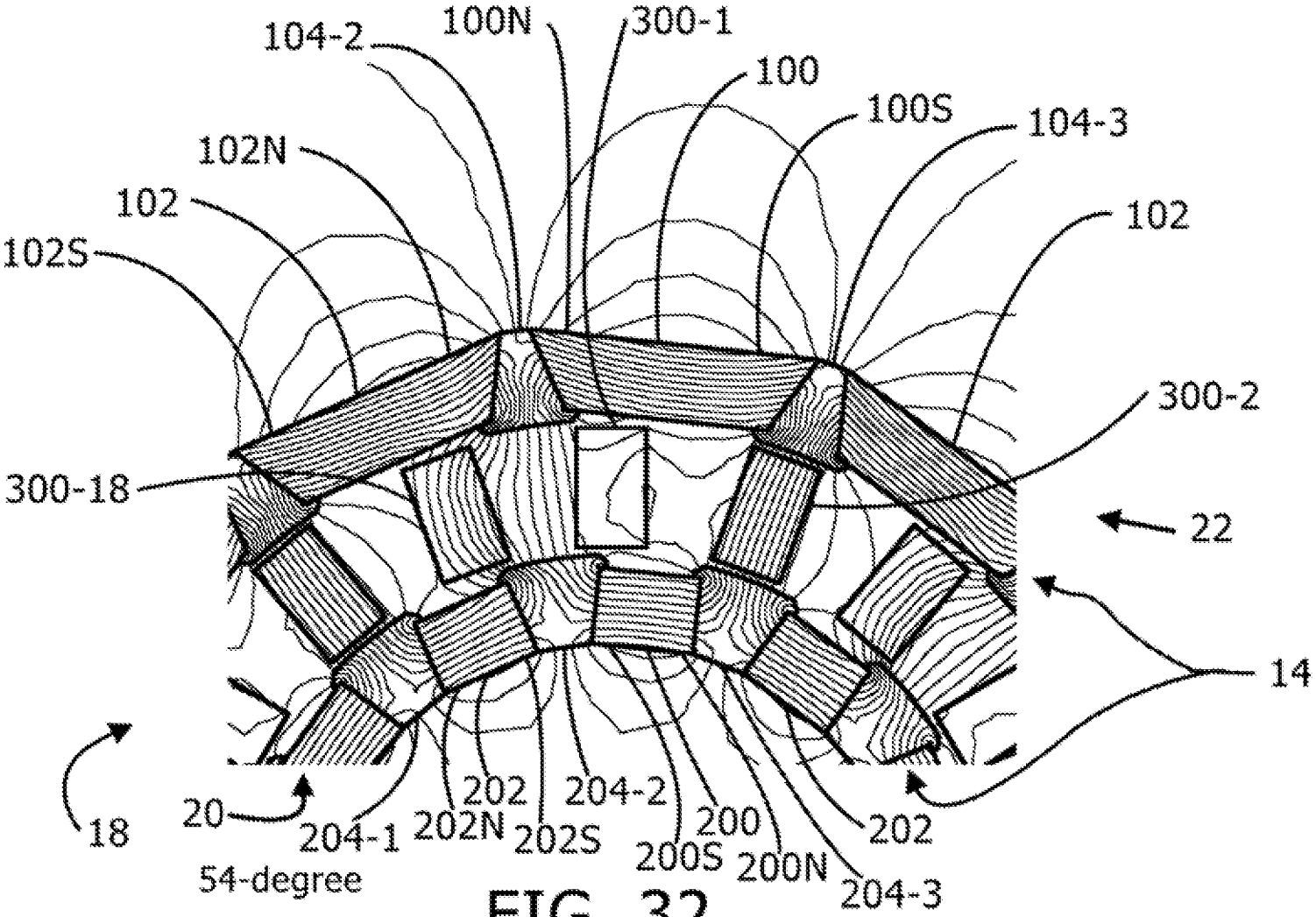
FIG. 32 is another view of the schematizied view of FIG. 5 with the rotor having advanced by 54 degrees from that shown in FIG. 5.
Figure 33:
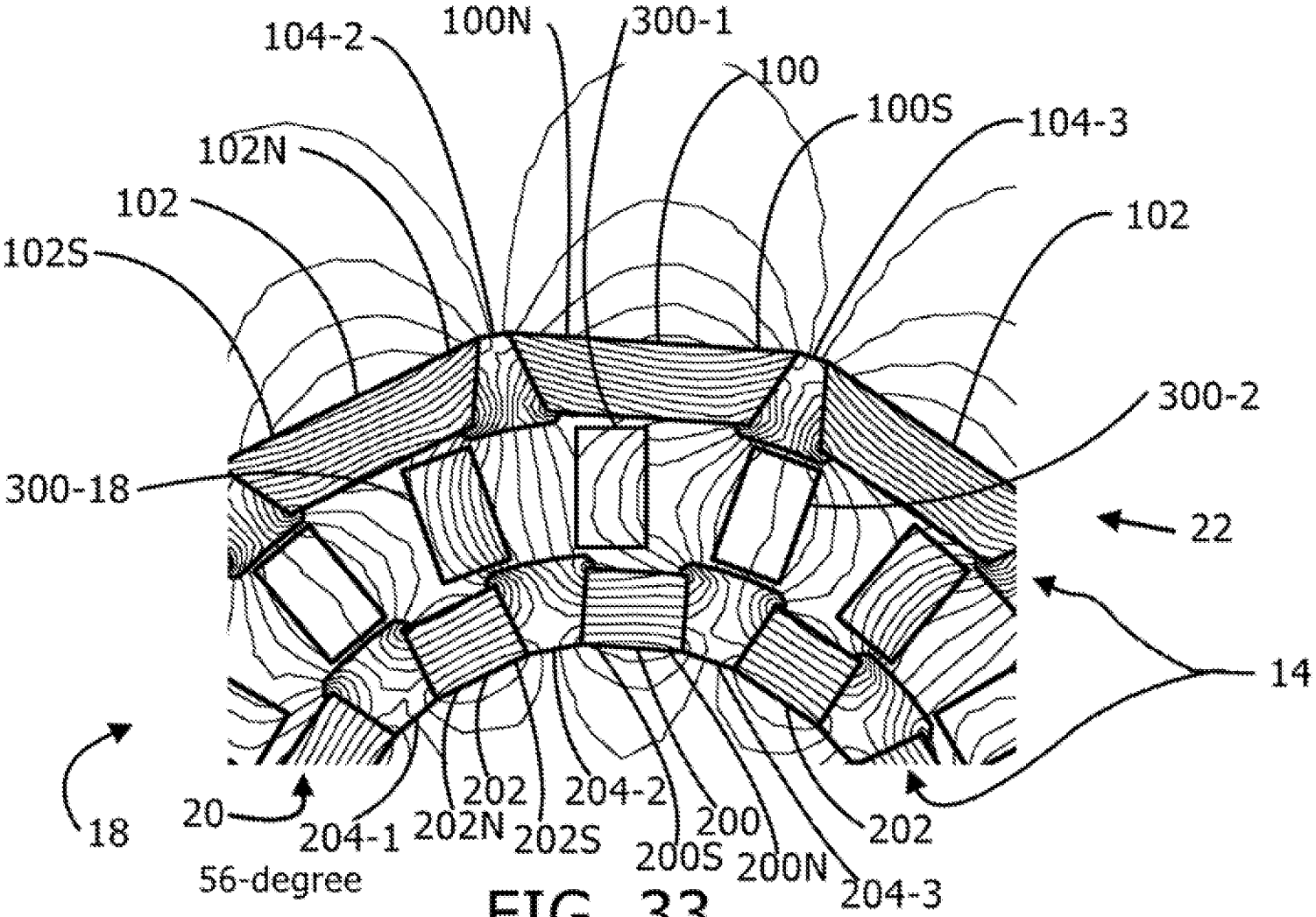
FIG. 33 is another view of the schematizied view of FIG. 5 with the rotor having advanced by 56 degrees from that shown in FIG. 5.
Figure 34:
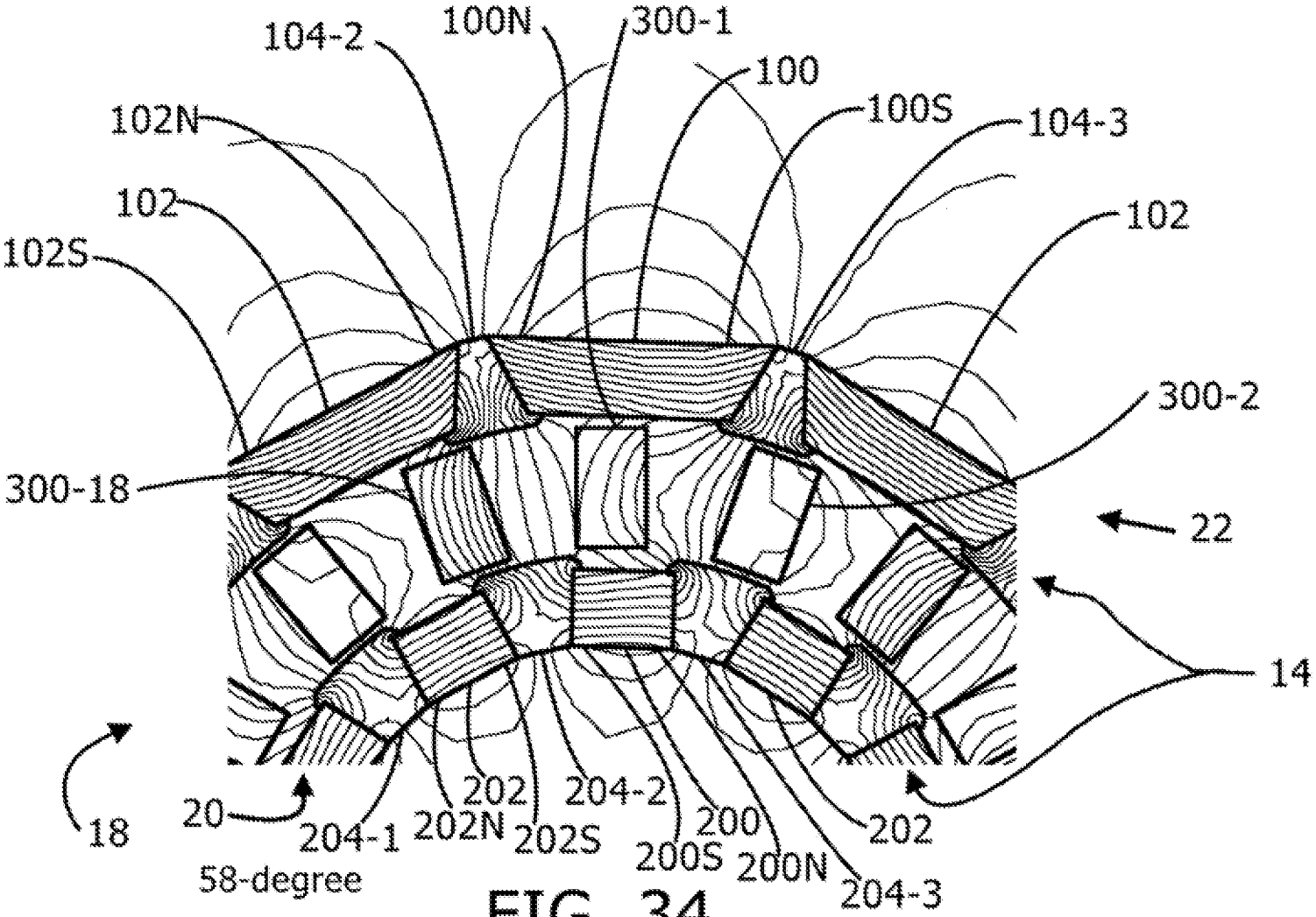
FIG. 34 is another view of the schematizied view of FIG. 5 with the rotor having advanced by 58 degrees from that shown in FIG. 5.
Figure 35:
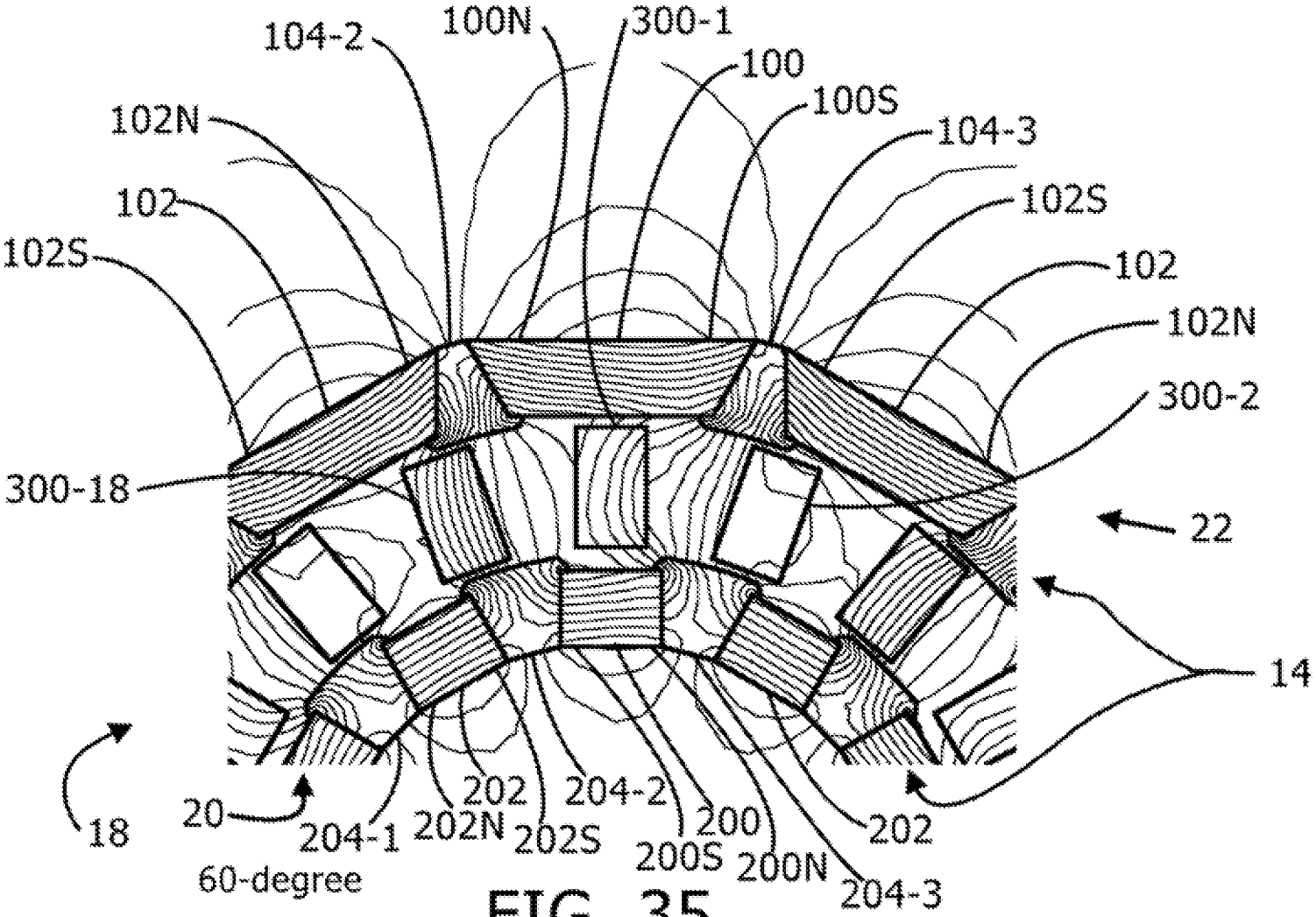
FIG. 35 is another view of the schematizied view of FIG. 5 with the rotor having advanced by 60 degrees from that shown in FIG. 5, with this example completing a complete magnetic cycle from that initiated in FIG. 5, with this illustration being the same as FIG. 5.

Then in FIG. 28 the electrical current going through electromagnetic member 300-1 is reversed to thereby reverse the magnetic field polarities so that the top is now N and the bottom is now S. This then causes the magnetic flux from ferrous members 104-2 and 204-2 to be rejected and member 300-1 now starts to repel the magnetic field emanating from ferrous members 104-2 and 204-2. This rejection of available magnetic flux continues in FIGS. 29-32, then in FIG. 33 we can see that electromagnetic member 300-2 has again switched magnetic polarity with some of the flux being directed through member 300-1. The magnetic flux density increases in electromagnetic member 300-1 in FIGS. 34 and 35 as rotor 14 continues its rotary motion. FIG. 35 brings us back to the condition shown in FIG. 5, with rotor 14 having moved 60 degrees.

It should be noted that the foregoing explanation of the interaction of magnetic fields as rotor 14 is moving is ongoing with each of the electromagnetic members 300-1 through 300-18 relative to their respective positions as the magnetic fields, mainly emanating from ferrous members 104-1 through 104-12 and 204-1 through 204-12, passes by the electromagnetic members 300-1 through 300-18.

As can be seen substantially all of the magnetic field of the magnetic circuits are contained within and between the construct of magnet assemblies 20 and 22. Magnets 100 and 102, as well as magnets 200 and 202 are in a bucking configuration with similar poles facing each other. This arrangement dramatically increases the intensity of the magnetic field in the air gap between ferrous members 104, 204 and electromagnetic members 300, particularly as they pass each other.

Even though the foregoing description uses magnets of similar strengths, it is also contemplated to use magnets that having differing magnetic strengths and shapes. While the description of the invention has described an inventive electric motor with a selected number of magnets, ferrous members, and electromagnets, it is contemplated that the numbers of each can vary.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electric motor, comprising:

a first magnetic assembly including:

an even plurality of a first set of magnets arranged in a generally circular arrangement, each magnet of the first set of magnets having a first pole and a second pole, the magnets of the first set of magnets each being aligned with the first pole directed at the first pole of an adjacent magnet of the first set of magnets and the second pole directed at the second pole of an adjacent magnet of the first set of magnets, the first set of magnets having a radially inward face and a radially outward face, the first set of magnets having a trapezoidal-shape, the radially outward face having a surface that is larger than a surface of the radially inward face; and an even plurality of a first set of ferrous members with a corresponding one of the ferrous members of the first set of ferrous members being positioned between each set of poles of the first set of magnets, each of the first set of ferrous members having a face that is directed radially inward and a radially outward face, the first set of ferrous members having a trapezoidal-shape, the radially outward face of the first set of ferrous members being smaller than the radially inward face of the first set of ferrous members;

a second magnetic assembly connected to the first magnetic assembly, the second magnetic assembly including:

an even plurality of a second set of magnets arranged in a generally circular arrangement, each magnet of the second set of magnets having a first pole and a second pole, the magnets of the second set of magnets being aligned with the first pole directed at the first pole of an adjacent magnet of the second set of magnets and the second pole directed at the second pole of an adjacent magnet of the second set of magnets; and an even plurality of a second set of ferrous members with a corresponding one of the ferrous members of the second set of ferrous members being positioned between each set of poles of the second set of magnets, each of the second set of ferrous members being trapezoidal-shaped, each of the second set of ferrous members having a radially outward face and a radially inward face, the radially outward face having a surface that is larger than a surface of the radially inward face; and an electromagnetic assembly including a plurality of electromagnetic members arranged in a generally circular arrangement, each electromagnetic member having a ferrous element with an electrical conductor wound around the ferrous element, each ferrous element having a radially outward face and a radially inward face, the first magnetic assembly and the second magnetic assembly being rotatably coupled to the electromagnetic assembly, the radially outward faces of the ferrous elements being directed to the faces of the first set of ferrous members as the first set of ferrous members pass the ferrous elements as the first and second magnet assemblies rotate relative to the electromagnetic assembly, the radially inward faces of the ferrous elements being directed to the faces of the second set of ferrous members as the second set of ferrous members pass the ferrous elements as the first and second magnetic assemblies rotate about an axis relative to the electromagnetic assembly, the radially inward and radially outward directions being relative to the axis, all of the first poles being the same magnetic polarity and all of the second poles being the same magnetic polarity which is opposite of the magnetic polarity of the first poles, the radially inward face of the first set of ferrous members being radially outward from a corresponding one of the radially outward face of the second set of ferrous members.

2. The electric motor of claim 1 wherein the face of the first set of ferrous members extend inwardly toward the axis from the first set of magnets, the first set of ferrous members additionally extending partially along a side of the magnets adjacent to each of the first set of ferrous members, the face of the second set of ferrous members extend outwardly away from the axis from the second set of magnets, the second set of ferrous members additionally extending partially along a side of the magnets adjacent to each of the second set of ferrous members, the radially inward face of the first set of magnets being larger than the radially outward face of the first set of magnets.

3. An electric motor, comprising:

at least one magnetic assembly including a first magnetic and a second magnetic assembly, the first magnetic assembly having:

a plurality of magnets arranged along an arc, the plurality of magnets including a first magnet and a second magnet, the first magnet having a first magnetic pole and a second magnetic pole, the arc having a first radius from an axis, the plurality of magnets having a trapezoidal-shape, the plurality of magnets having a radially inward face and a radially outward face, the radially outward face of the plurality of magnets having a surface that is larger than a surface of the radially inward face of the plurality of magnets; and the second magnet having a first magnetic pole and a second magnetic pole, the first magnetic pole of the first magnet and the first magnetic pole of the second magnet being proximate to each other and facing each other thereby defining a first magnetic zone therebetween, the first magnetic poles all being of the same polarity, and the second magnetic poles all being of the same polarity, the first magnet and the second magnet having a trapezoidal-shaped ferrous piece therebetween, the ferrous piece having a radially outward surface that is smaller than a radially inward surface; and at least one magnetic driving element proximate to the first magnetic assembly, the at least one magnetic driving element producing a magnetic field that is primarily orthogonal within the at least one magnetic driving element to a direction of movement of the first magnetic assembly about the axis, the magnetic field of the at least one magnetic driving element switching polarity as the first magnetic zone passes a first face of the at least one magnetic driving element; and the second magnetic assembly having:

a plurality of magnets arranged along an arc, the plurality of magnets of the second magnetic assembly including a first magnet and a second magnet, the first magnet of the second magnetic assembly having a first magnetic pole and a second magnetic pole, the arc of the second magnetic assembly being along a second radius from the axis that is smaller than the first radius, the second magnet of the second magnetic assembly having a first magnetic pole and a second magnetic pole, the first magnetic pole of the first magnet of the second magnetic assembly and the first magnetic pole of the second magnet of the second magnetic assembly being proximate to each other and facing each other thereby defining a second magnetic zone therebetween, the first magnetic poles all being of the same polarity, and the second magnetic poles all being of the same polarity, the first and second magnets of the second magnetic assembly having a trapezoidal-shaped ferrous piece therebetween, the ferrous piece having a radially outward surface that is larger than a radially inward surface, the at least one magnetic driving element being proximate to the second magnetic assembly, the at least one magnetic driving element producing a magnetic field that is primarily orthogonal within the at least one magnetic driving element to a direction of movement of the first magnetic assembly and the second magnetic assembly about the axis, the magnetic field of the at least one magnetic driving element switching polarity as the second magnetic zone passes a second face of the at least one magnetic driving element, the first magnetic zone and the second magnetic zone being arranged to face each other with the magnetic driving element being therebetween.

4. The electric motor of claim 3, wherein the at least one magnetic assembly further includes a first ferrous member positioned between the first magnetic pole of the first magnet and the first magnetic pole of the second magnet, the first ferrous member coupling a substantial amount of the magnetic field emanating from the first magnetic poles and directing the substantial amount of the magnetic field to a gap between the ferrous member and the at least one magnetic driving element, the first ferrous member having a radially inward face and a radially outward face, the radially outward face of the first ferrous member being larger than the radially inward face of the first ferrous member.

5. The electric motor of claim 4, wherein said ferrous member extends from between the first magnetic poles along a portion of a side of the first magnet and along a portion of a side of the second magnet.

6. The electric motor of claim 4, wherein the first magnetic zone has a magnetic field strength of at least 2 Tesla in the ferrous member.

7. The electric motor of claim 6, wherein the magnetic field strength is at least 3 Tesla.

8. The electric motor of claim 3, wherein the magnetic assembly further includes:

a third magnet having a first magnetic pole and a second magnetic pole, the second magnetic pole of the third magnet being proximate to the second magnetic pole of the second magnet and facing each other thereby defining a second magnetic zone; and a second ferrous member positioned between the second magnetic pole of the second magnet and the second magnetic pole of the third magnet.

9. The electric motor of claim 3, wherein the first radius is larger than the second radius, the at least one magnetic driving element being positioned radially between the arc of the first magnetic assembly and the arc of the second magnetic assembly.

10. The electric motor of claim 9, wherein the plurality of magnets in the first magnetic assembly is equal in number to a number of the plurality of magnets in the second magnetic assembly.

11. The electric motor of claim 10, wherein the at least one magnetic driving element is a plurality of magnetic driving elements, a number of the plurality of magnetic driving elements being different than the number of the plurality of magnets in the first magnetic assembly and the plurality of magnets in the second magnetic assembly.

12. The electric motor of claim 9, wherein the first magnetic zone of the first magnetic assembly and the second magnetic zone of the second magnetic assembly are of opposite magnetic polarity.

13. The electric motor of claim 9, wherein the first magnetic zone of the first magnetic assembly is arranged generally radially outward from the second magnetic zone of the second magnetic assembly.

14. A load driving machine, comprising:

an electrical motor coupled to a load, the electrical motor including:

at least one magnetic assembly including a first magnetic assembly and a second magnetic assembly, the first magnetic assembly having:

a plurality of magnets arranged along an arc, the plurality of magnets including a first magnet and a second magnet, the first magnet having a first magnetic pole and a second magnetic pole, the arc having a first radius from an axis, the plurality of magnets having a trapezoidal-shape, the plurality of magnets having a radially inward face and a radially outward face, the radially inward face of the plurality of magnets being smaller than the radially outward face of the plurality of magnets; and the second magnet having a first magnetic pole and a second magnetic pole, the first magnetic pole of the first magnet and the first magnetic pole of the second magnet being proximate to each other and facing each other thereby defining a first magnetic zone therebetween, the first magnetic poles all being of the same polarity, and the second magnetic poles all being of the same polarity, the first magnet and the second magnet having a trapezoidal-shaped ferrous piece therebetween, the ferrous piece having a radially outward surface that is smaller than a radially inward surface; and at least one magnetic driving element proximate to the first magnetic assembly, the at least one magnetic driving element producing a magnetic field that is primarily orthogonal within the at least one magnetic driving element to a direction of movement of the at least one magnetic assembly about the axis, the magnetic field of the at least one magnetic driving element switching polarity as the first magnetic zone passes a first face of the at least one magnetic driving element; and the second magnetic assembly having:

a plurality of magnets arranged along an arc, the plurality of magnets of the second magnetic assembly including a first magnet and a second magnet, the first magnet of the second magnetic assembly having a first magnetic pole and a second magnetic pole, the arc of the second magnetic assembly being along a second radius from the axis that is smaller than the first radius, the second magnet of the second magnetic assembly having a first magnetic pole and a second magnetic pole, the first magnetic pole of the first magnet of the second magnetic assembly and the first magnetic pole of the second magnet of the second magnetic assembly being proximate to each other and facing each other thereby defining a second magnetic zone therebetween, the first magnetic poles all being of the same polarity, and the second magnetic poles all being of the same polarity, the first and second magnets of the second magnetic assembly having a trapezoidal-shaped ferrous piece therebetween, the ferrous piece having a radially outward surface that is larger than a radially inward surface, the at least one magnetic driving element being proximate to the second magnetic assembly, the at least one magnetic driving element producing a magnetic field that is primarily orthogonal within the at least one magnetic driving element to a direction of movement of the first magnetic assembly and the second magnetic assembly about the axis, the magnetic field of the at least one magnetic driving element switching polarity as the second magnetic zone passes a second face of the at least one magnetic driving element, the first magnetic zone and the second magnetic zone being arranged to face each other with the magnetic driving element being therebetween.

15. The load driving machine of claim 14, wherein the at least one magnetic assembly further includes a first ferrous member positioned between the first magnetic pole of the first magnet and the first magnetic pole of the second magnet, the first ferrous member coupling a substantial amount of the magnetic field emanating from the first magnetic poles and directing the substantial amount of the magnetic field to a gap between the ferrous member and the at least one magnetic driving element.

16. The load driving machine of claim 15, wherein said ferrous member extends from between the first magnetic poles along a portion of a side of the first magnet and along a portion of a side of the second magnet.

17. The load driving machine of claim 15, wherein the first magnetic zone has a magnetic field strength of at least 2 Tesla.

18. The load driving machine of claim 17, wherein the magnetic field strength is at least 3 Tesla.

19. The load driving machine of claim 14, wherein the magnetic assembly of the electric motor further includes:

a third magnet having a first magnetic pole and a second magnetic pole, the second magnetic pole of the third magnet being proximate to the second magnetic pole of the second magnet and facing each other thereby defining a second magnetic zone; and a second ferrous member positioned between the second magnetic pole of the second magnet and the second magnetic pole of the third magnet.

* * * * *